US011151908B2

(12) United States Patent
Kott et al.

(10) Patent No.: US 11,151,908 B2
(45) Date of Patent: Oct. 19, 2021

(54) DISPLAY HOLDER SYSTEM

(71) Applicant: Illen Products Ltd., Richmond (CA)

(72) Inventors: Marla Charisse Kott, Vancouver (CA); Kristin Sarah MacMillan, West Vancouver (CA); Alexander Jeffrey Feldman, Vancouver (CA); Robbie Gordon Roberts, Port Moody (CA)

(73) Assignee: Illen Products Ltd., Richmond, CA (US)

( * ) Notice: Subject to any disclaimer, the term of this patent is extended or adjusted under 35 U.S.C. 154(b) by 0 days.

(21) Appl. No.: 14/722,850

(22) Filed: May 27, 2015

(65) Prior Publication Data

US 2015/0371566 A1 Dec. 24, 2015

Related U.S. Application Data

(60) Provisional application No. 62/015,371, filed on Jun. 20, 2014.

(51) Int. Cl.

| | |
|---|---|
| ***G09F 3/18*** | (2006.01) |
| ***G09F 3/20*** | (2006.01) |
| *G09F 7/18* | (2006.01) |
| *G09F 21/02* | (2006.01) |

(52) U.S. Cl.

CPC ..... *G09F 3/207* (2013.01); *G09F 3/20* (2013.01); *G09F 21/023* (2020.05); *G09F 2007/1852* (2013.01)

(58) Field of Classification Search

CPC ..... A44C 3/001; A44C 3/002; G09F 3/207; G09F 3/12; G09F 3/18; G09F 3/20; G09F 2021/023; G09F 2007/1852; H04M 1/21; H04B 1/3888

USPC ..... 248/206.5, 205.1, 220.21, 228.8, 126, 248/688, 683, 558

See application file for complete search history.

(56) References Cited

U.S. PATENT DOCUMENTS

| | | | |
|---|---|---|---|
| D14,417 | S | 11/1883 | Planque |
| 1,055,453 | A | 3/1913 | Durnan |
| 1,400,564 | A | 12/1921 | Metzger |
| 1,570,368 | A | 1/1926 | Zeh |
| 1,765,325 | A | 6/1930 | Day |
| 1,785,186 | A | 12/1930 | Day |
| 1,849,904 | A | 3/1932 | Bott |

(Continued)

FOREIGN PATENT DOCUMENTS

| | | |
|---|---|---|
| CA | 91099 | 12/2000 |
| CA | 108005 | 9/2005 |

(Continued)

OTHER PUBLICATIONS

Imprint Plus, "solutions 2007 product sampler", 2007.

*Primary Examiner* — Cassandra Davis
(74) *Attorney, Agent, or Firm* — McDonald Hopkins LLC

(57) ABSTRACT

A system for forming display holders, such as name badges, identification badges, name plates, signs and the like, from modular, interchangeable components. In one embodiment a display holder is provided comprising a display subassembly having a cover and a backer plate releasably connectable to the cover, the plate having a first connector located on a rear surface of the plate. The display holder also includes a second connector releasably connectable to the first connector for positioning the display subassembly relative to a support surface.

30 Claims, 52 Drawing Sheets

(56) References Cited

U.S. PATENT DOCUMENTS 1,867,964 A 7/1932 Bott
2,145,296 A 1/1939 Draper et al.
D115,418 S 6/1939 Meuller
2,232,060 A 2/1941 Foster
2,338,264 A 1/1944 Shaw et al.
2,448,611 A 9/1948 Martin
D152,399 S 1/1949 Dwinell
D152,497 S 1/1949 Price et al.
2,564,110 A 8/1951 Howenstine et al.
3,144,695 A 8/1964 Budwig
3,212,204 A 10/1965 Smith
3,256,626 A 6/1966 Stoffel
3,407,523 A 10/1968 Winston
D213,625 S 3/1969 Jensen et al.
3,557,478 A 1/1971 Sitzberger
3,694,947 A * 10/1972 Mukai ..... A47G 1/142 40/771
D234,166 S 1/1975 Silverman
D234,274 S 2/1975 Seyler
4,183,159 A 1/1980 Isaac
4,184,275 A 1/1980 Thornell
4,198,772 A 4/1980 Furutu
4,236,331 A 12/1980 Mattson
4,270,288 A * 6/1981 Sulzer ..... G09F 1/12 40/661
4,459,772 A 7/1984 Kanzelberger
D280,469 S 9/1985 Heyman et al.
D281,705 S 12/1985 Rosenberg
4,597,206 A 7/1986 Benson
D303,402 S 9/1989 Brown
D320,235 S 9/1991 Hofman
5,224,600 A 7/1993 Neugebauer
5,283,966 A * 2/1994 Rader ..... A44C 3/001 40/1.5
D351,694 S 10/1994 Evans
5,369,899 A 12/1994 Reeves
5,398,435 A 3/1995 Kanzelberger
5,410,827 A 5/1995 Smith
D369,093 S 4/1996 Chiodaroli
D382,598 S 8/1997 Schroeppel
D382,735 S 8/1997 Zapf
D386,067 S 11/1997 Hamerski et al.
D386,209 S 11/1997 Firestone et al.
5,699,326 A 12/1997 Haas et al.
5,714,215 A 2/1998 Sheffield et al.
5,873,606 A 2/1999 Haas et al.
D415,467 S 10/1999 Starkey
5,997,683 A 12/1999 Popat
D434,452 S 11/2000 Steiner et al.
D443,655 S 6/2001 Chaikel et al.
D448,579 S 10/2001 Prade
6,360,464 B1 3/2002 Tate
6,446,372 B1 9/2002 Reeves
D463,731 S 10/2002 Striebel
6,594,934 B1 * 7/2003 Wong ..... A47G 1/0616 40/738
D480,760 S 10/2003 Wieth et al.
D481,684 S 11/2003 Bomar
D483,653 S 12/2003 Immerman
6,671,986 B2 1/2004 Reeves
6,726,252 B1 * 4/2004 Chaikel ..... G09F 3/00 283/105
6,742,294 B1 6/2004 Fossum
6,745,508 B1 * 6/2004 Ngan ..... G09F 3/20 40/642.02
D493,640 S 8/2004 Nemec et al.
D499,383 S 12/2004 Bomar
D500,091 S 12/2004 Sjoberg
D546,892 S 7/2007 Bruegmann
D548,796 S 8/2007 Sachnoff
D574,819 S 8/2008 Andre et al.
7,421,810 B2 9/2008 Schymura
D593,614 S 6/2009 Didulo et al.
D595,362 S 6/2009 Maier-Hunke
D600,756 S 9/2009 Fleming
D619,361 S 7/2010 Andre et al.
D622,716 S 8/2010 Andre et al.
7,802,390 B2 * 9/2010 Reis ..... A47G 1/0605 40/711
D633,051 S 2/2011 Nurmi et al.
D643,467 S 8/2011 Yi et al.
D644,693 S 9/2011 Braat et al.
D649,195 S 11/2011 Yi et al.
D649,594 S 11/2011 Yi et al.
8,122,625 B2 * 2/2012 Maier-Hunke ..... G09F 3/207 40/1.6
D667,412 S 9/2012 Wang et al.
8,676,281 B1 * 3/2014 Caulder ..... H04M 1/0283 455/575.1
D716,380 S 10/2014 Burkhart et al.
D731,991 S 6/2015 Berdut-Teruel
9,061,934 B2 6/2015 Bisson et al.
D735,565 S 8/2015 Serra et al.
D740,367 S 10/2015 White
D744,040 S 11/2015 Schloss
9,189,983 B2 11/2015 English
9,196,177 B2 11/2015 English
D747,178 S 1/2016 Rothbaum et al.
D757,184 S 5/2016 Balanchi
9,611,881 B2 * 4/2017 Khodapanah ..... F16B 21/06
2002/0095751 A1 7/2002 Reiter
2005/0023420 A1 2/2005 Sadeh et al.
2006/0059757 A1 * 3/2006 Didulo ..... G09F 3/207 40/737
2006/0086025 A1 4/2006 Benedict et al.
2008/0226846 A1 9/2008 Hill
2009/0033648 A1 2/2009 Podd et al.
2009/0064555 A1 * 3/2009 Schymura ..... A47G 1/22 40/738
2009/0084705 A1 * 4/2009 Justiss ..... A45F 5/02 206/724
2009/0101025 A1 4/2009 Penson
2010/0116955 A1 5/2010 Hayes et al.
2010/0223826 A1 9/2010 Brown
2011/0159333 A1 6/2011 Xie et al.
2012/0067834 A1 3/2012 Gokey
2013/0337224 A1 12/2013 Odani et al.
2014/0065366 A1 3/2014 Joubaud
2014/0213139 A1 7/2014 Ferguson
2015/0085220 A1 3/2015 Chen et al.
2020/0076937 A1 * 3/2020 Ackerman ..... H04M 1/21

FOREIGN PATENT DOCUMENTS

CA 117158 12/2007
CA 133171 5/2011
EP 000672845-0001 5/2007
EP 000672845-0002 5/2007
EP 001641663-0001 12/2009
EP 001641663-0002 12/2009

* cited by examiner

FIG. 50
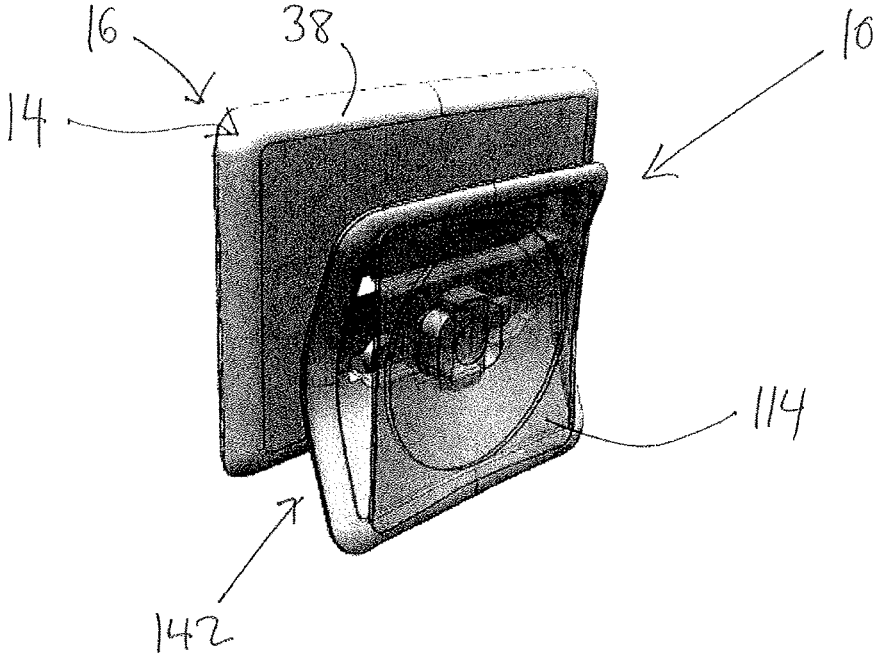
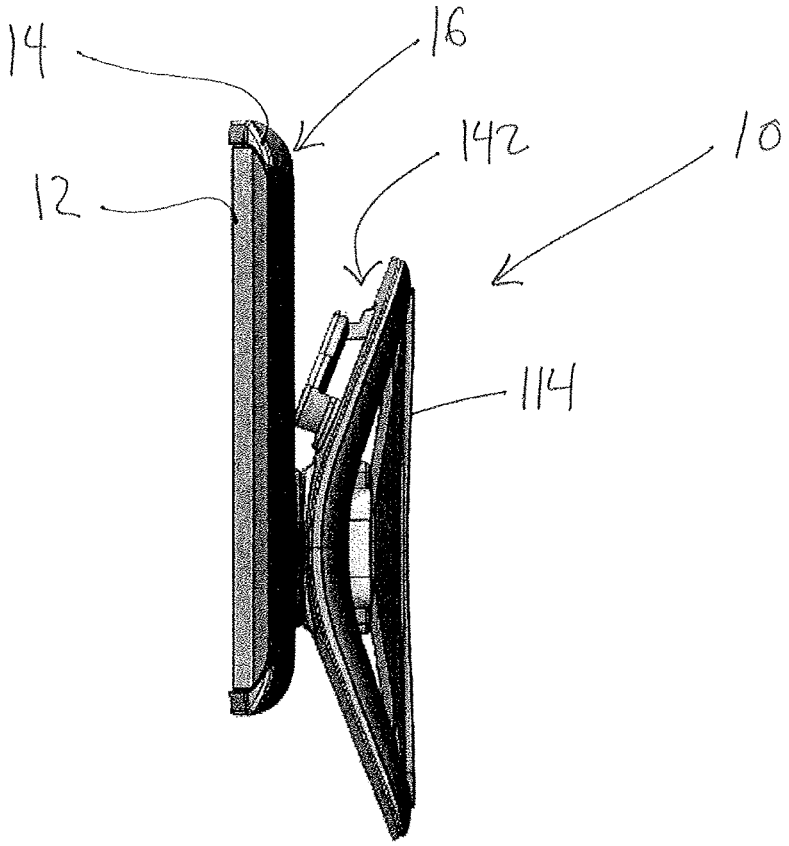
FIG. 51

DISPLAY HOLDER SYSTEM

RELATED APPLICATIONS

This application claims the benefit of the priority of U.S. provisional patent application No. 62/015,371 filed 20 Jun. 2014, which is incorporated herein by reference in its entirety.

TECHNICAL FIELD

This application relates to a system for forming display holders, such as name badges, identification badges, name plates, signs and the like, from modular, interchangeable components.

BACKGROUND

Many reusable name badges, desk signs, product signs and other similar signage systems are known in the prior art. For example, in U.S. Pat. No. 6,726,252 issued 27 Apr. 2004, the disclosure of which is incorporated herein by reference in its entirety, a computer-controlled identifier tag production system is described for producing wearable identifier tag assemblies, such as customized name badges. Each assembly comprises a plastic holder, a printed identifier tag or label, and a rigid backer sheet. The rigid backer sheet may consist of a sheet of metal plate to enable the assembly to be held in position on an article of clothing using a magnet. Alternatively, the backer sheet may comprise a conventional pin or similar fastener.

While prior art reusable name badge and signage systems are in widespread use and have been very successful, they suffer from some drawbacks. Many prior art systems use adhesives to join badge or sign components. This means that they cannot be used in applications which could compromise the integrity of the adhesives, such where components need to be cleaned or sterilized in dishwashers after each use. For example, reusable signage systems are commonly used in restaurants and hotel dining rooms to label food served at buffets. Since food or beverages may occasionally spill on to such signs, it is important that they be easily cleaned to avoid bacterial contamination and to comply with heath regulations. Apart from the use of adhesives, problems can also arise where sign parts are soldered together, creating small gaps where bacteria can potentially collect.

There are also drawbacks to name badges and signs using metal components. Such products are relatively heavy and are more expensive to manufacture and ship. Also, if metal components are used in combination with plastic or other components, the different tolerances and material characteristics of the components, such as variable shrinkage rates at different temperatures, may cause product failures in some applications.

A further drawback of many conventional name badge and signage systems is that they are restricted to particular dedicated uses. For example, badges or signs designed for one particular application cannot be easily disassembled and reassigned to other applications. This requires customers to purchase different signage systems for different applications which is more expensive and environmentally wasteful, particular if the signs are not readily reusable.

A need has therefore arisen for display holders which may be assembled from lightweight, modular, interchangeable components and which are foodsafe and dishwasher safe.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one embodiment a display holder is provided comprising a display subassembly having a cover and a backer plate releasably connectable to the cover, the backer plate having a first connector located on a rear surface of the plate. The display holder also includes a second connector releasably connectable to the first connector for positioning the display subassembly relative to a support surface.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

FIG. 50 is a rear perspective of the display holder of FIG. 49 in an assembled configuration.

FIG. 51 is a side view of the display holder of FIG. 49 in an assembled configuration.

DESCRIPTION

Figure 1:
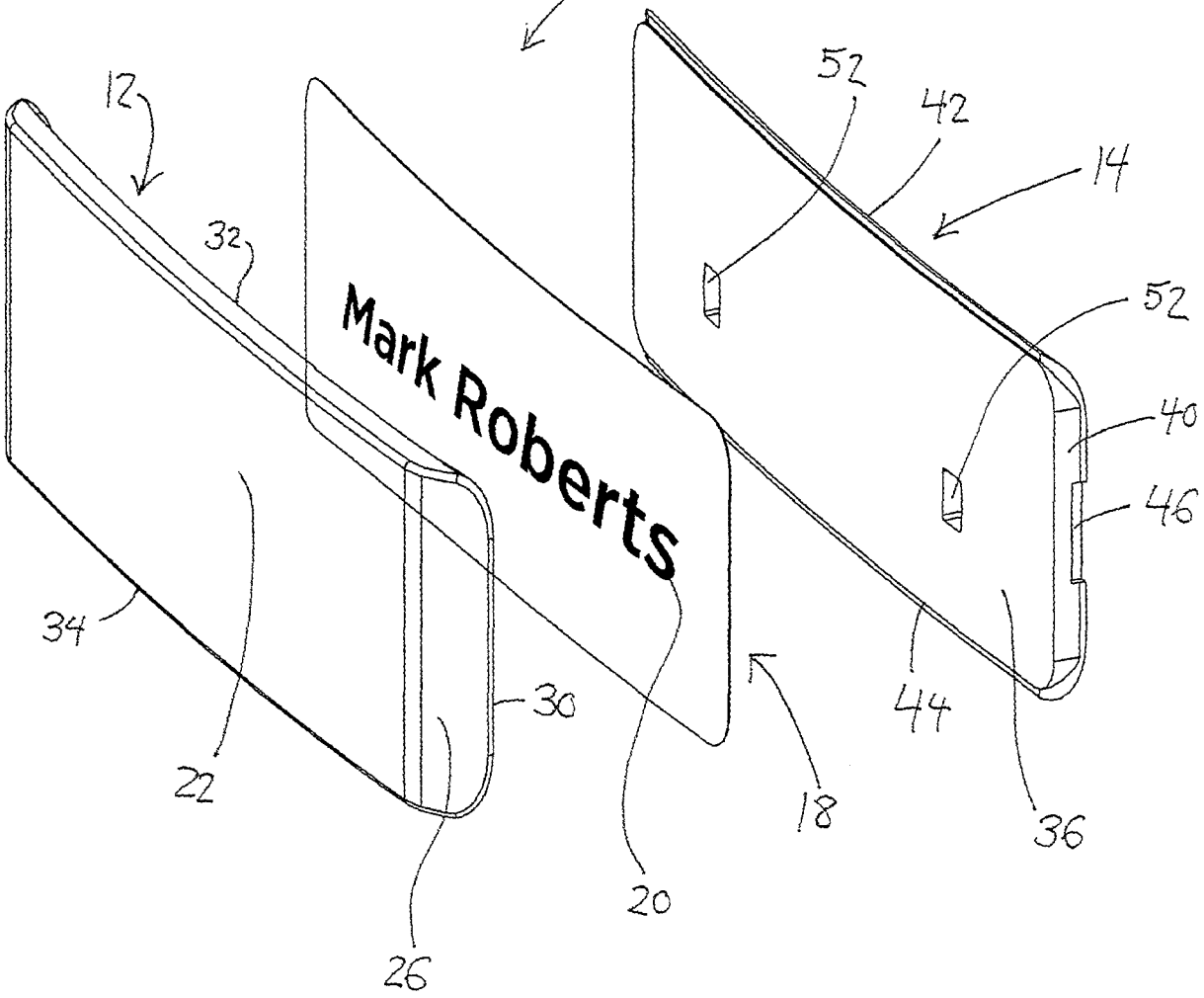
FIG. 1 is an exploded, front perspective view of an embodiment of applicant's display subassembly configured as a name badge.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This application relates to a system for forming display holders 10, such as name badges, name plates, signs and the like, from modular, interchangeable components. In most applications holder 10 is designed to display printed information, such as the name and/or title of an employee or company, an identification number or photo, a product name or description, a food or beverage name or photo, or any other information or indicia. As described below, display holder 10 may be configured for displaying information in a wide variety of applications and on different support surfaces, including articles of clothing, desks or other furniture, walls or doors, glass surfaces, bulletin boards, warehouse racks or shelving and the like. Depending upon the application, display holder 10 may be free-standing or fixed at a desired location.

FIGS. 1-7 illustrate component parts for a display holder 10 configured as wearable name badge. Holder 10 includes a cover 12 and a backer plate 14 which are releasably connectable to form a display subassembly 16. Optionally, one or more insert sheets 18 bearing indicia 20 may be placed between cover 12 and backer plate 14. As explained below, insert sheets 18 may be created by an end user and included in subassembly 16 as desired. If cover 12 is transparent or semi-transparent, indicia 20 of insert sheet 18 may be visible through cover 12 when display holder 10 is assembled. In one embodiment insert sheet 18 may be a sheet of transparent film printed with indicia 20. As explained further below, some or all of backer plate 14 may also be visible through cover 12 and insert sheet 18 when display subassembly 16 is assembled. In other embodiments sheet 18 may be translucent or opaque. In some embodiments backer plate 14 and/or other component parts of display holder 10 may have a frosted rather than an optically clear appearance.

In the embodiment of FIG. 1 backer plate 14 fits within cover 12 so that cover 12 has a streamlined, "frameless" appearance. Cover 12 may consist of a clear plastic lens having an outer surface 22, an inner surface 24 and gently curved side surfaces 26. A pair of connecting tabs 28 are located at opposed ends 30 of cover 12 (FIGS. 2 and 4) and project inwardly a short distance for engaging backer plate 14 as discussed below. Cover 12 also includes top and bottom surfaces 32 and 34 which may also comprise tabs or slots in some embodiments for releasably engaging mating structures on backer plate 14.

Backer plate 14 includes a front surface 36, a rear surface 38, ends 40 and top and bottom surfaces 42 and 44. In the embodiment of FIG. 1, a pair of slots 46 may be formed in respective ends 40. Tabs 28 of cover 12 releasably snap into respective slots 46 when cover 12 and backer plate 14 are coupled together to form subassembly 16. In other embodiments top and bottom surfaces 42, 44 of backer plate 14 may also include slots for receiving mating tabs or ribs formed on cover 12, or vice versa. As will be apparent to a person skilled in the art, many variations are possible to achieve a snap-fit releasable connection between cover 12 and backer plate 14 with one or more insert sheet(s) 18 disposed therebetween.

As in other prior art reusable signage systems, display subassembly 16 exhibits the advantage that insert sheet 18 may be easily removed from subassembly 16 for replacement with one or more substitute insert sheets 18. For example, if the name or position of an employee changes, the old sheet 18 may be removed from subassembly 16 and discarded and a new sheet 18 bearing the corrected or updated indicia 20 may be substituted. Since no adhesives are used, the applicant's system does not result in a sticky and potentially unsightly residue on backer plate 14. This feature is particularly attractive to large companies using customized backer plates 14 and/or having a large amount of staff turnover. As described in applicant's U.S. Pat. No. 6,726,252, the disclosure of which is incorporated herein by reference in its entirety, substitute insert sheets 18 or tags can be quickly and easily produced, for example by an end user, using conventional desktop printers.

Figure 2:
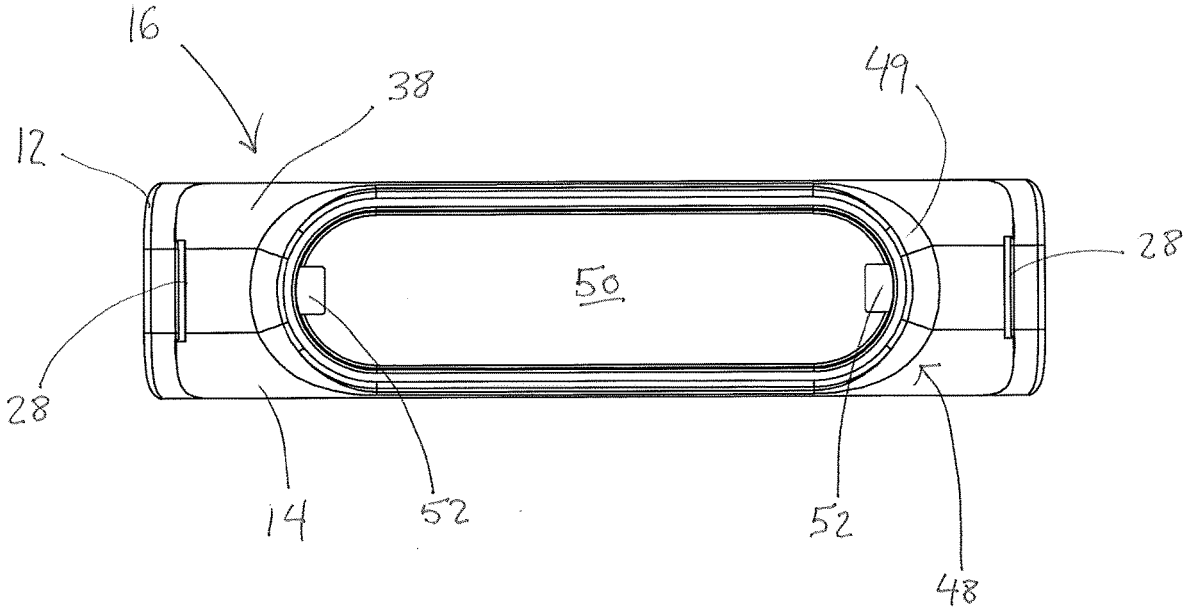
FIG. 2 is a rear elevational view of the subassembly of FIG. 1.
Figure 3D:
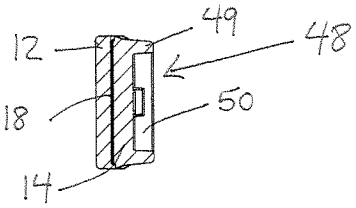
FIG. 3D is a cross-sectional view of the subassembly of FIG. 1 taken along section lines B-B of FIG. 3A.
Figure 3A:
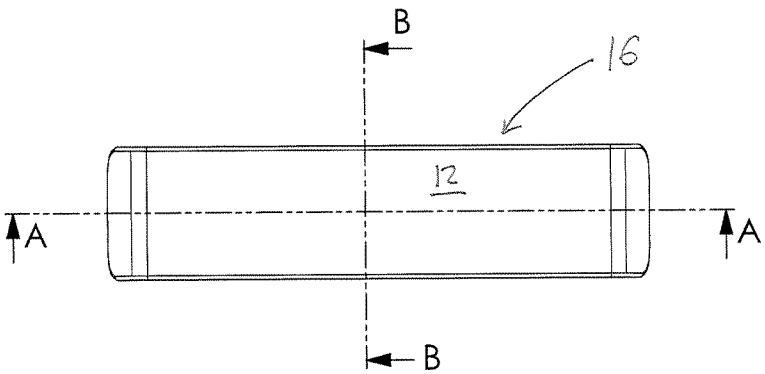
FIG. 3A is a front elevational view of the subassembly of FIG. 1.
Figure 3C:
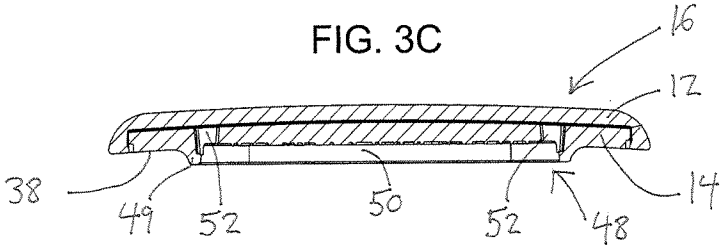
FIG. 3C is a longitudinal sectional view of the subassembly of FIG. 1 taken along section lines A-A of FIG. 3A.
Figure 3B:
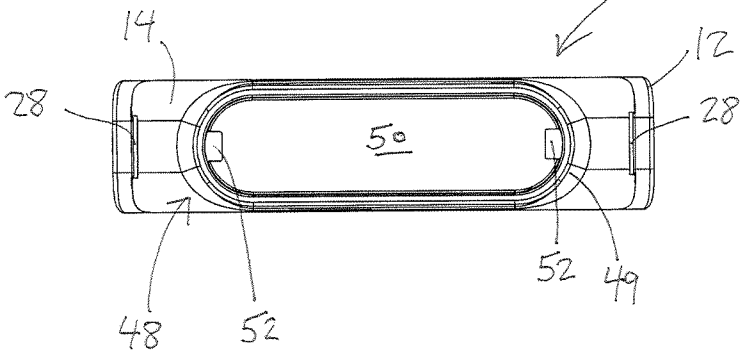
FIG. 3B is a rear elevational view of the subassembly of FIG. 1.
Figure 4:
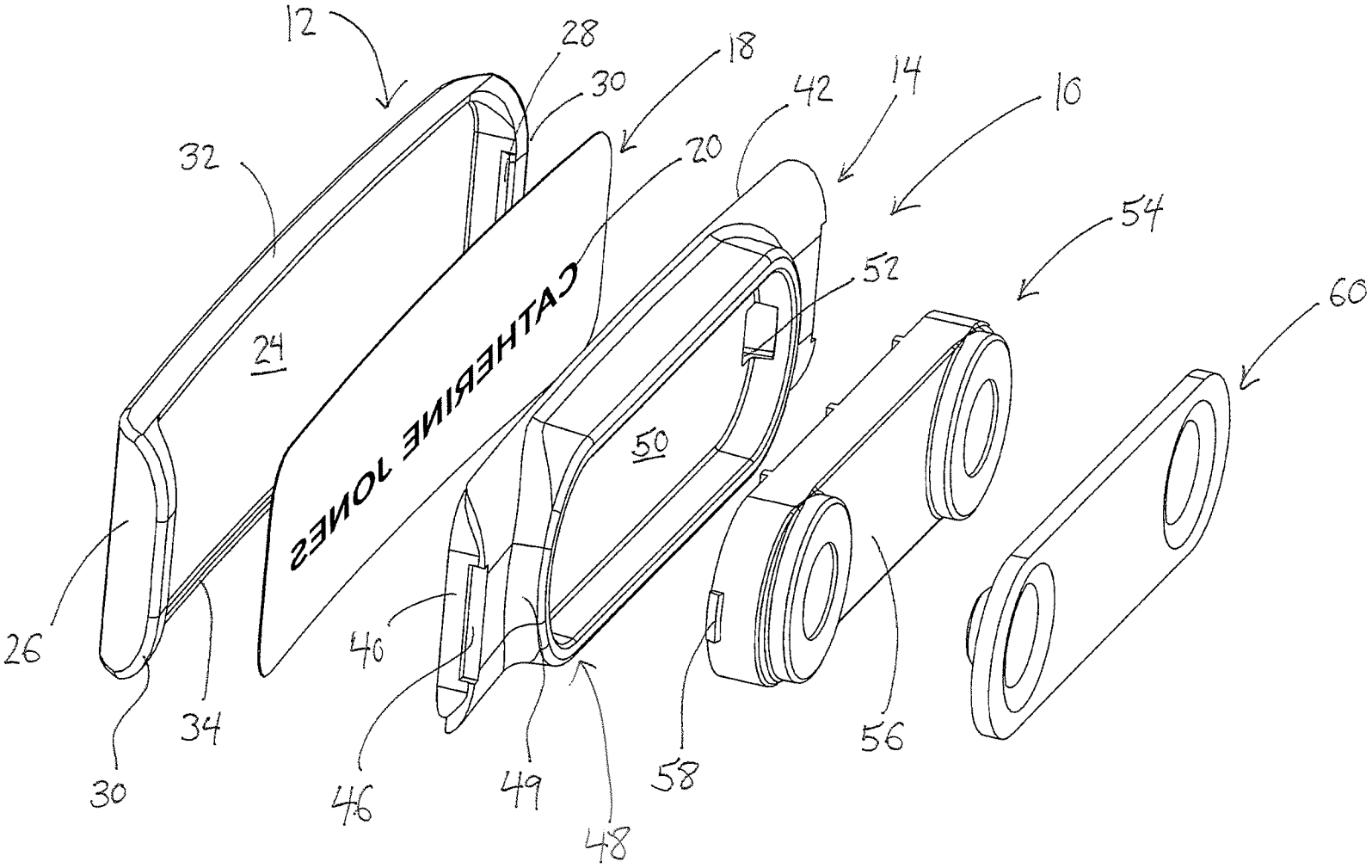
FIG. 4 is a rear perspective view of an embodiment of applicant's display holder comprising the display subassembly of FIG. 1, a magnet accessory, and a metal fastener for positioning the display subassembly on an article of clothing.
Figure 5:
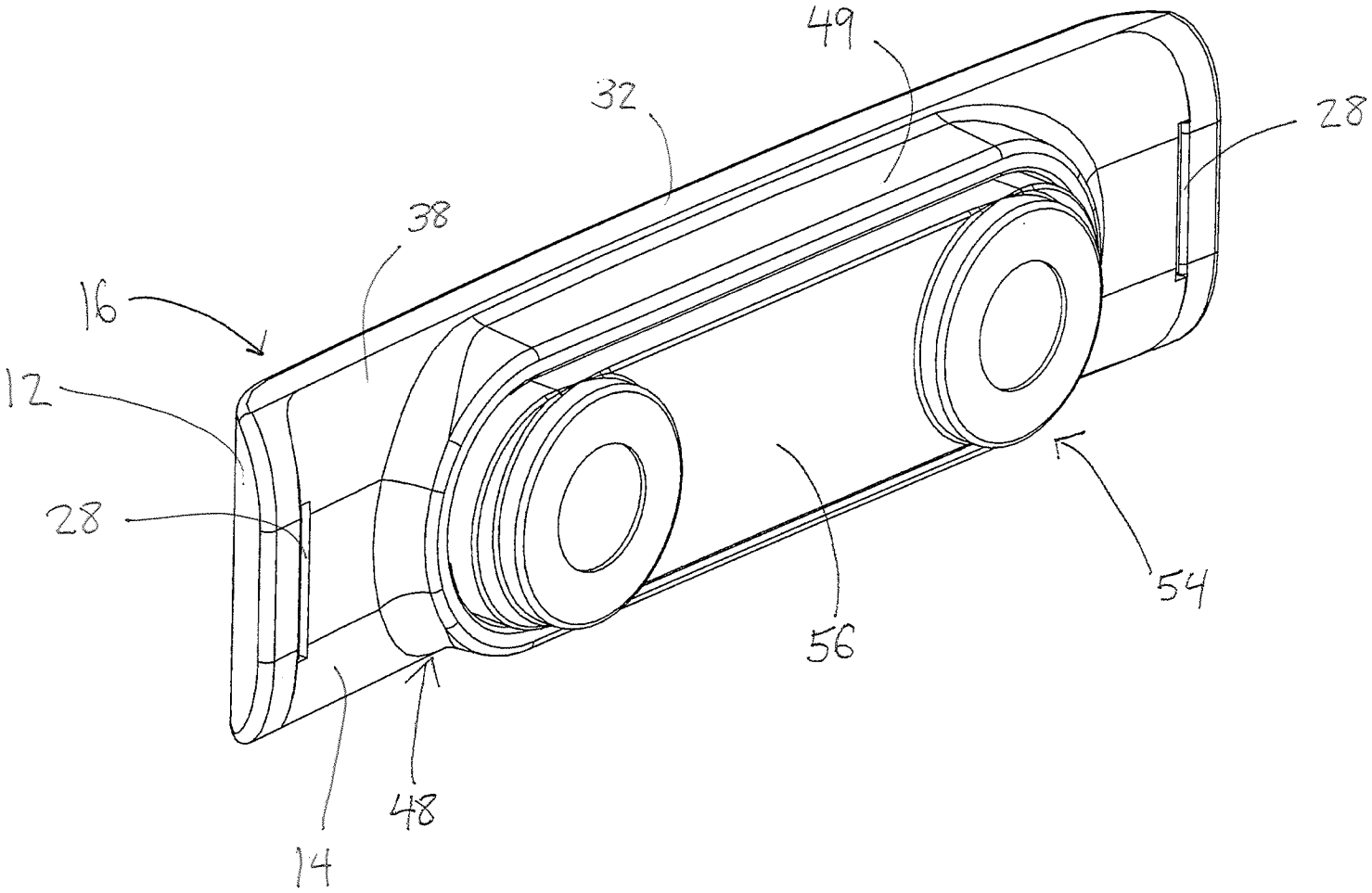
FIG. 5 is a rear perspective view of the display subassembly and magnet accessory of FIG. 4 showing the magnet accessory coupled to the backer plate.
Figure 6A:
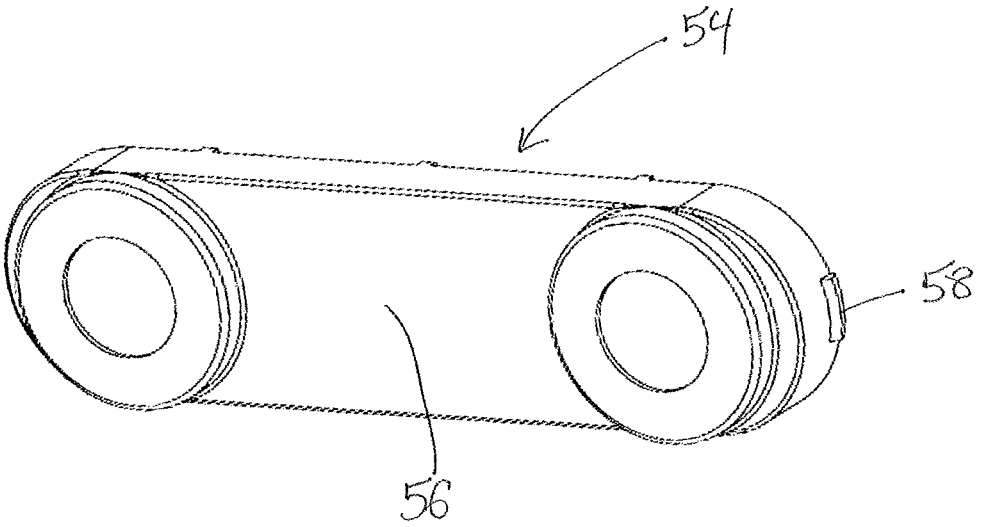
FIG. 6A is a rear perspective view of the magnet accessory of FIG. 4.
Figure 6B:
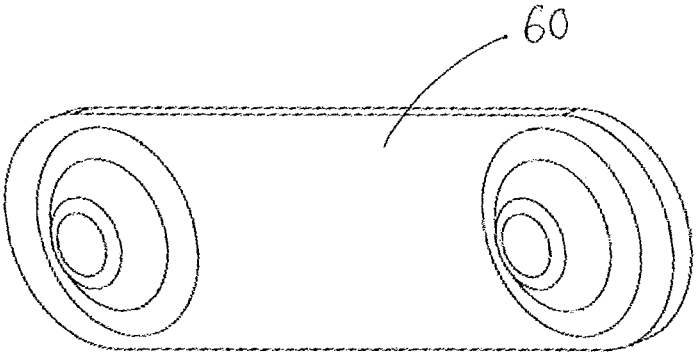
FIG. 6B is a rear perspective view of the metal fastener of FIG. 4.

As shown best in FIGS. 2-4, a first connector 48 is formed on rear surface 38 of back plate 14. In the embodiment of FIGS. 1-4, first connector 48 includes a protruding rib 49 which defines a recess 50 forming a female socket. One or more slots 52 may be formed within recess 50, for example at end portions of recess 50 adjacent rib 49 (FIG. 2). Display subassembly 16 may be removably positioned on a support surface, directly or indirectly, by releasably coupling first connector 48 to a second connector 54. As described herein, second connector 54 may be configured in many different forms for deploying holder 10 on different support surfaces.

For example, as shown in FIG. 4, holder 10 may be configured for positioning display subassembly 16 on an article of clothing. In this embodiment second connector 54 is a magnet accessory 56 which is sized to releasably fit within recess 50. Magnet accessory 56 includes tabs 58 which are received in slots 52 of first connector 48 when first and second connectors 48, 54 are coupled together. As will be appreciated by a person skilled in the art, different configurations of slots, undercuts, protuberances, tabs, and the like may be provided for achieving a snap-fit between first and second connectors 48, 54. In this embodiment magnet accessory 56 may be coupled to a metal plate 60 which is positioned behind an article of clothing (not shown). The magnetic attraction between magnet accessory 56 and metal plate 60 maintains display holder 10 in place at the desired location.

In an alternative embodiment, metal plate 60 may be configured as a second connector 54 sized to snap-fit within recess 50 of first connector 48. In this embodiment metal plate 60 may include tabs 58 which are received in slots 52 of first connector 48 when first and second connectors 48, 54 are coupled together as described above. In this embodiment a magnet accessory 56 (with or without tabs 58) may be positioned behind an article of clothing (not shown). As in the first embodiment described above, the magnetic attraction between metal plate 60 and magnet accessory 56 maintains display holder 10 in place at the desired location.

One advantage of the first embodiment described above, where magnet accessory 56 functions as a second connector 54 received in recess 50 of first connector 48 (FIG. 5), is that magnets are relatively expensive as compared to metal plates. Magnets are less likely to be lost or misplaced if they are securely connected to the user's display subassembly 16 functioning as a name badge. An additional advantage is that display subassembly 16, and attached magnet accessory 56, can be secured to a metal bulletin board or the like when display holder 10 is not worn on an article of clothing. For example, at the end of a user's shift display holder 10 may be partly disassembled by separating metal plate 60 from magnet accessory 56 and then positioning magnet accessory 56 and attached display subassembly 16 (FIG. 5) on a different support surface for storage or alternative display purposes.

Figure 7:
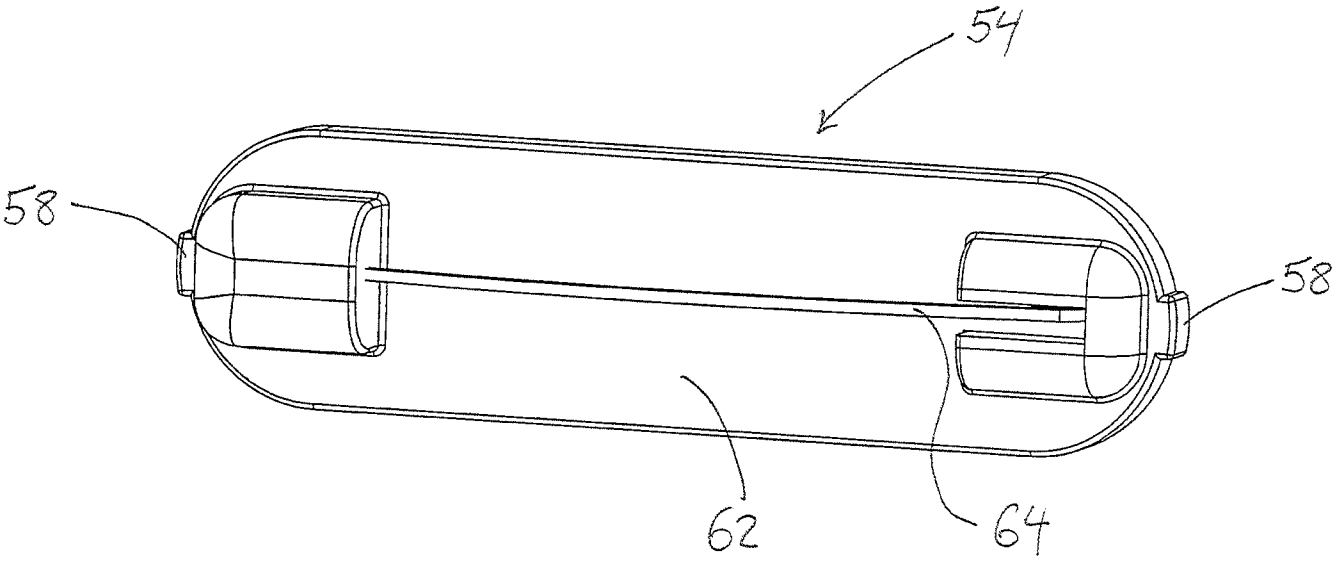
FIG. 7 is a rear perspective view of a pin connector.

In a further alternative embodiment illustrated in FIG. 7, a pin accessory 62 comprising tabs 58 may fit within recess 48 of first connector 50. Pin accessory 62 includes a pin 64 for fastening display holder 10 on an article of clothing.

As will be apparent to a person skilled in the art, display subassemblies 16 may be configured in many different shapes and sizes depending upon the application. FIGS. 8-11 illustrate an embodiment where subassembly 16 comprises a cover 12 and backer plate 14 which are rectangular in shape but which are larger in size than the name badge embodiment of FIGS. 1-7. For example, the display subassembly 16 of FIG. 8 could be deployed as a wearable credit card-size identification badge including a photo rather than a name badge including text only.

Figure 8:
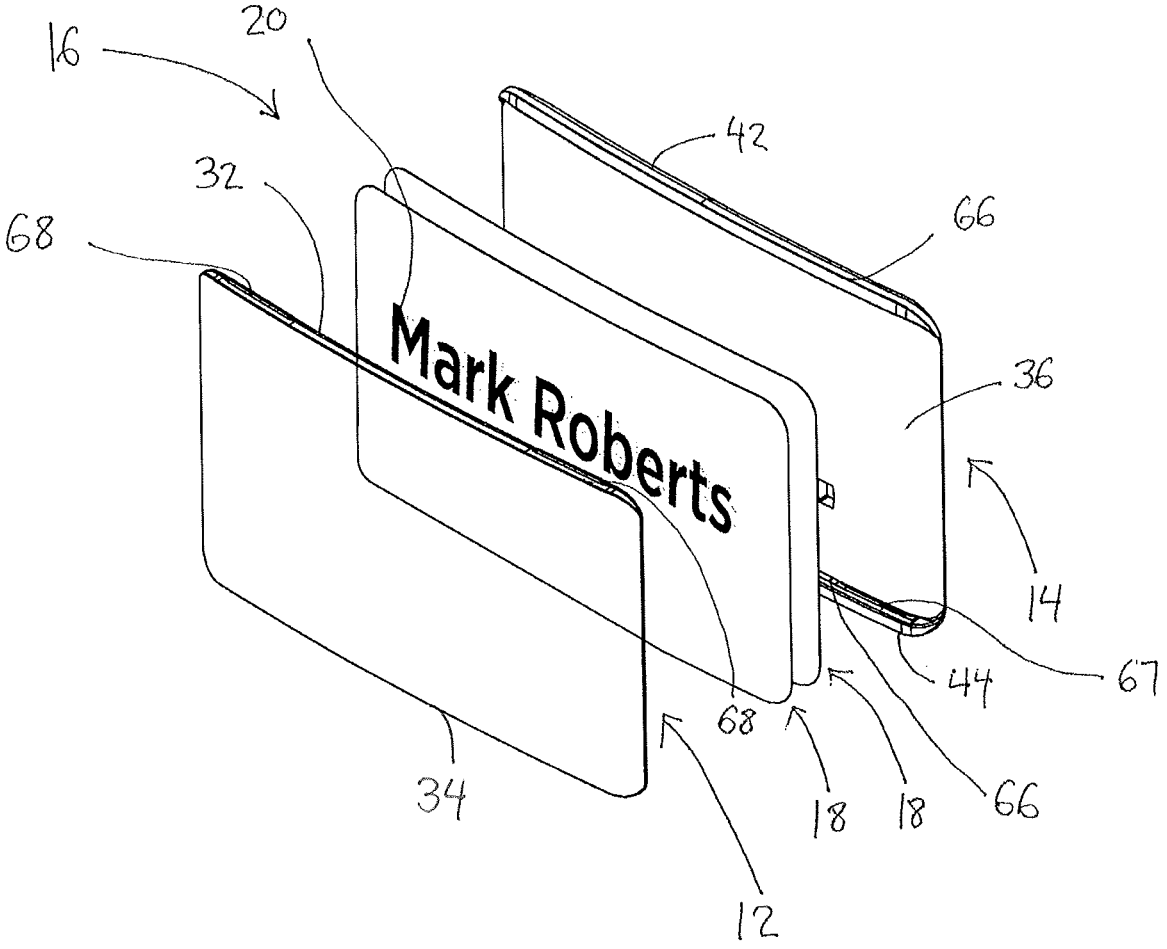
FIG. 8 is an exploded, front perspective view of an embodiment of applicant's display subassembly configured as an identification badge.

In the embodiment of FIG. 8 cover 12 fits within backer plate 14 rather than vice versa. In particular, as shown best in FIG. 8, backer plate 14 may include a flanged rim 66 extending along top and bottom edges 42, 44 thereof. In this embodiment backer plate 14 is not flanged along the side edges thereof. In one embodiment each rim 66 may include one or more narrow undercut slots 67. Cover 12 may comprise a plurality of mating tabs 68 formed on upper and lower edges thereof which engage an adjacent rim 66, for example by being received in mating slots 67, when cover 12 and backer plate 14 are coupled together. In one embodiment tabs 68 may extend continuously along the upper and lower edges 32, 34 of cover 12 for engaging a corresponding rim 66 along its entire length. As will be apparent to a person skilled in the art, many other alternative arrangements for releasably coupling cover 12 and backer plate 14 together may be envisioned.

In the embodiment of FIG. 8, two insert sheets 18 are shown positionable within display subassembly 16. In this embodiment one sheet 18 is a transparent film printed with indicia 20 and the other sheet 18 is an opaque film to provide background contrast.

Figure 9:
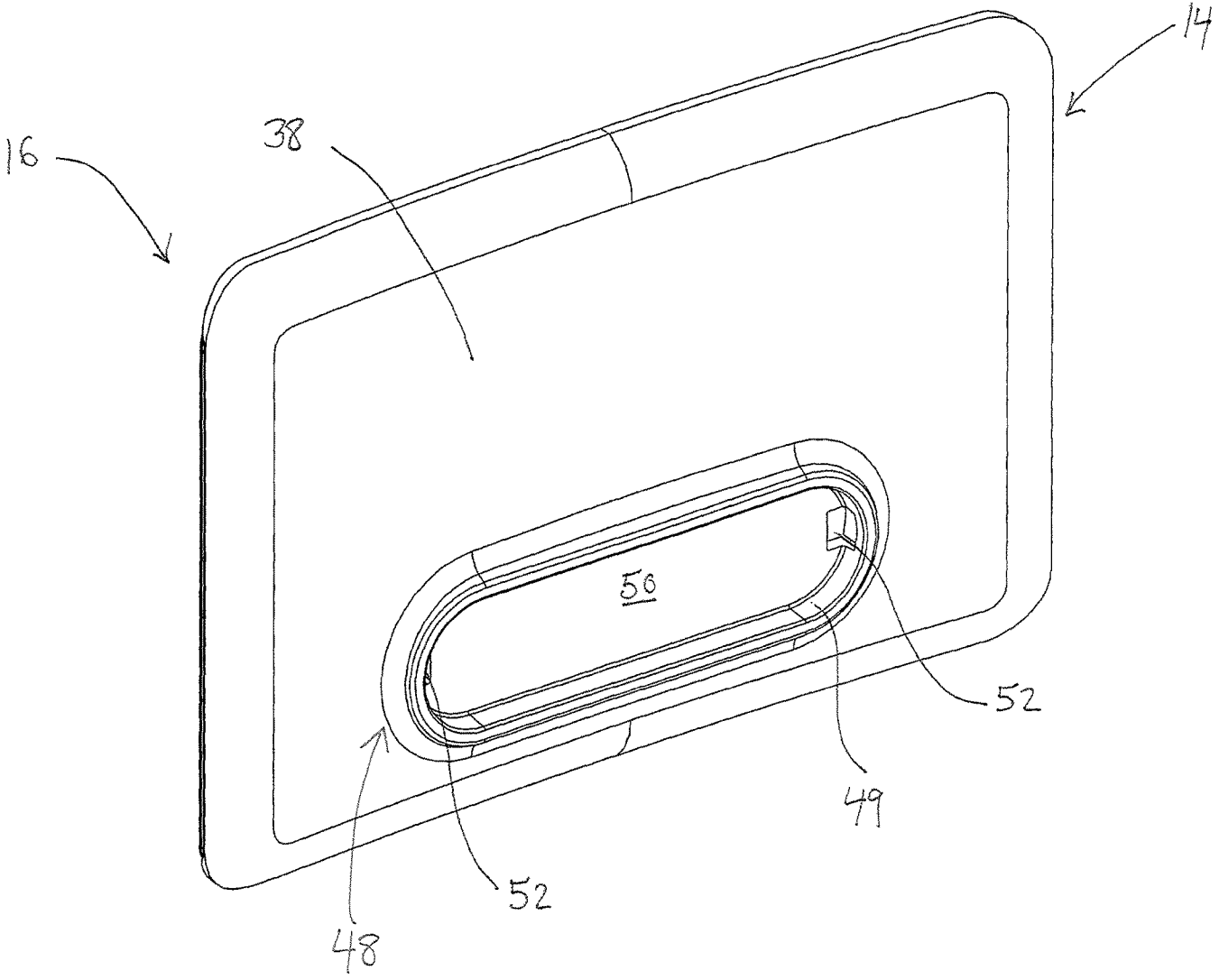
FIG. 9 is a rear perspective view of the subassembly of FIG. 8.
Figure 10D:
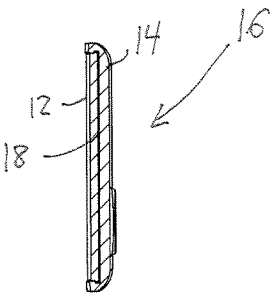
FIG. 10D is a cross-sectional view of the subassembly of FIG. 8 taken along section lines B-B of FIG. 10A.
Figure 10C:
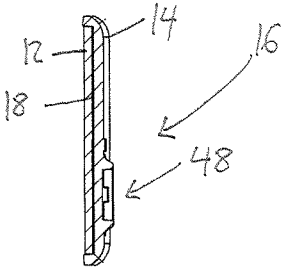
FIG. 10C is a cross-sectional view of the subassembly of FIG. 8 taken along section lines A-A of FIG. 10A.
Figure 10A:
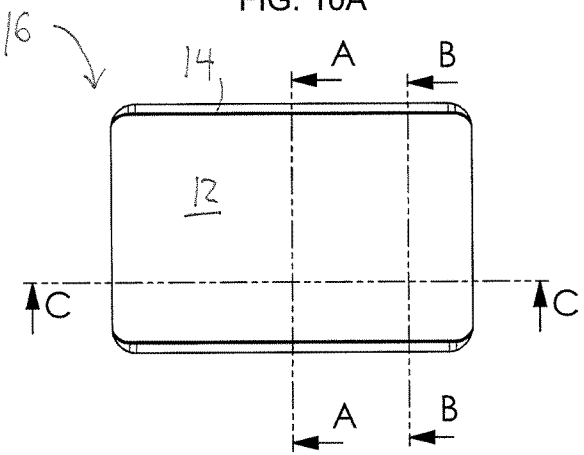
FIG. 10A is a front elevational view of the subassembly of FIG. 8.
Figure 10E:
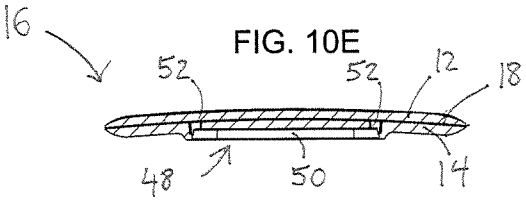
FIG. 10E is a longitudinal sectional view of the subassembly of FIG. 8 taken along section lines C-C of FIG. 10A.
Figure 10B:
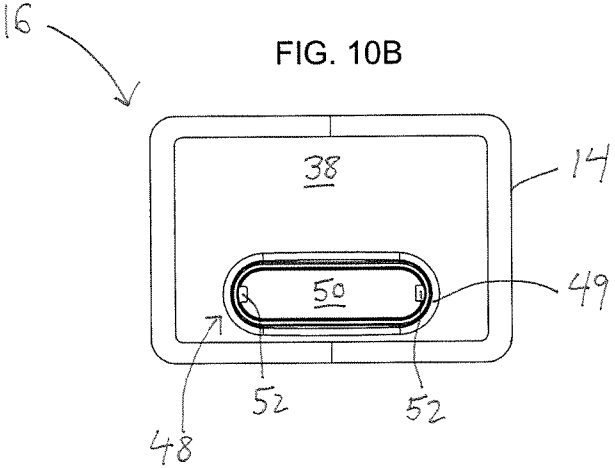
FIG. 10B is a rear elevational view of the subassembly of FIG. 8.
Figure 11:
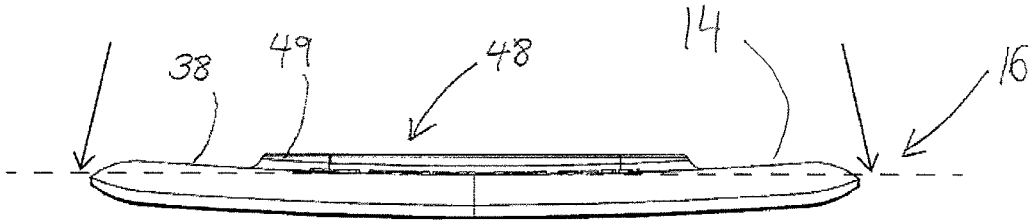
FIG. 11 is a top plan view of the display subassembly of FIG. 8 showing its adjustability between rest and flexed orientations.

As shown best in FIGS. 9 and 10, the embodiment of FIGS. 8-11 also has a first connector 48 formed on the rear surface 38 of backer plate 14, similar to the embodiment of FIG. 2. As shown in plan view in FIG. 11, subassembly 16 comprising cover 12 and backer plate 14 are both slightly inwardly convex in shape. That is, in one embodiment, inner surface 24 of cover 12 is slightly concave and outer surface 22 is slightly convex; similarly rear surface 38 of backer plate 14 is slightly concave and front surface 36 is slightly convex. Both cover 12 and backer plate 14 can be formed from a flexible material, such as molded polycarbonate or the like. As shown in FIG. 11, display subassembly 16 may therefore flex in the direction of the arrows from a slightly curved orientation to an approximate planar orientation. This flexing enables second connector 54 to be quickly and easily decoupled from first connector 48 by users without the need for any special tools or techniques. In particular, in one embodiment the flexing of backer plate 14 causes tabs 58 formed on a second connector 54 to be removed from mating slots 52 formed within recess 50 of first connector 48 (FIG. 4).

This "flex to release" functionality enables a display subassembly 16 to be quickly removed from one configuration and reassigned to another configuration, greatly enhancing the versatility of the overall system. By way of example, a display subassembly 16 may be used as part of a display holder 10 deployed as a sign identifying inventory stored in warehouse racks using a magnet accessory 56 as a second connector 54. The same subassembly 16 could be repurposed as a display holder 10 functioning as an identification badge for a visitor at the warehouse by quickly removing magnet accessory 56 and substituting a pin fastener accessory 62 for wear on an article of clothing. The informational content of display subassembly 16 could change by removing insert sheet 18 (e.g. an insert sheet 18 bearing indicia 20 identifying an inventory item) and substituting an insert sheet 18 bearing other indicia 20 (e.g. an insert sheet 18 printed with the visitor's name). By way of another example, a display subassembly 16 could be used as part of a display holder 10 functioning as a name badge for use by a teacher at a professional conference. The same subassembly 16 could also be repurposed as part of a display holder 10 functioning as a desk sign, as described further below.

Figure 12:
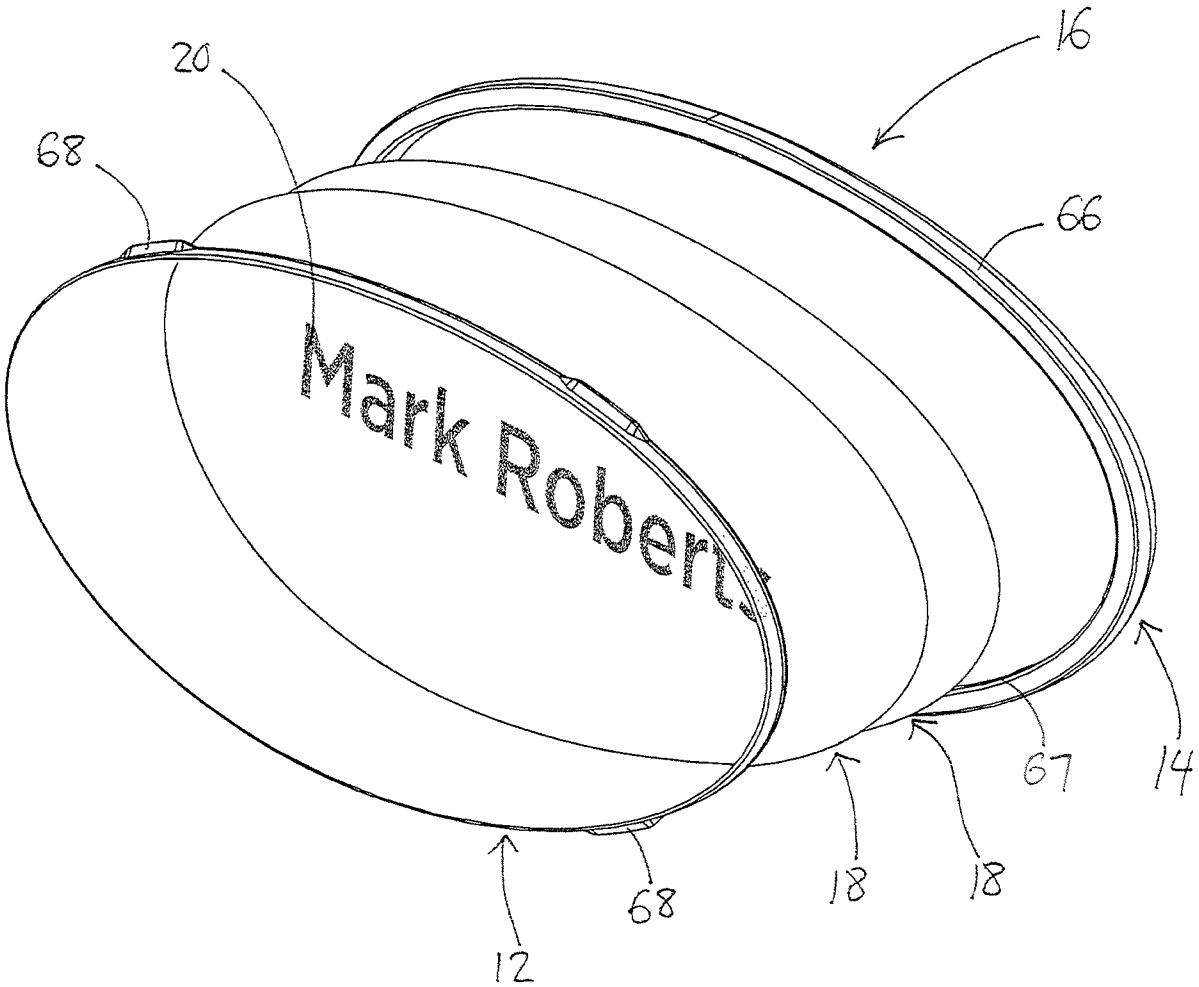
FIG. 12 is an exploded, front perspective view of an embodiment of applicant's display subassembly configured as an oval-shaped badge.
Figure 13:
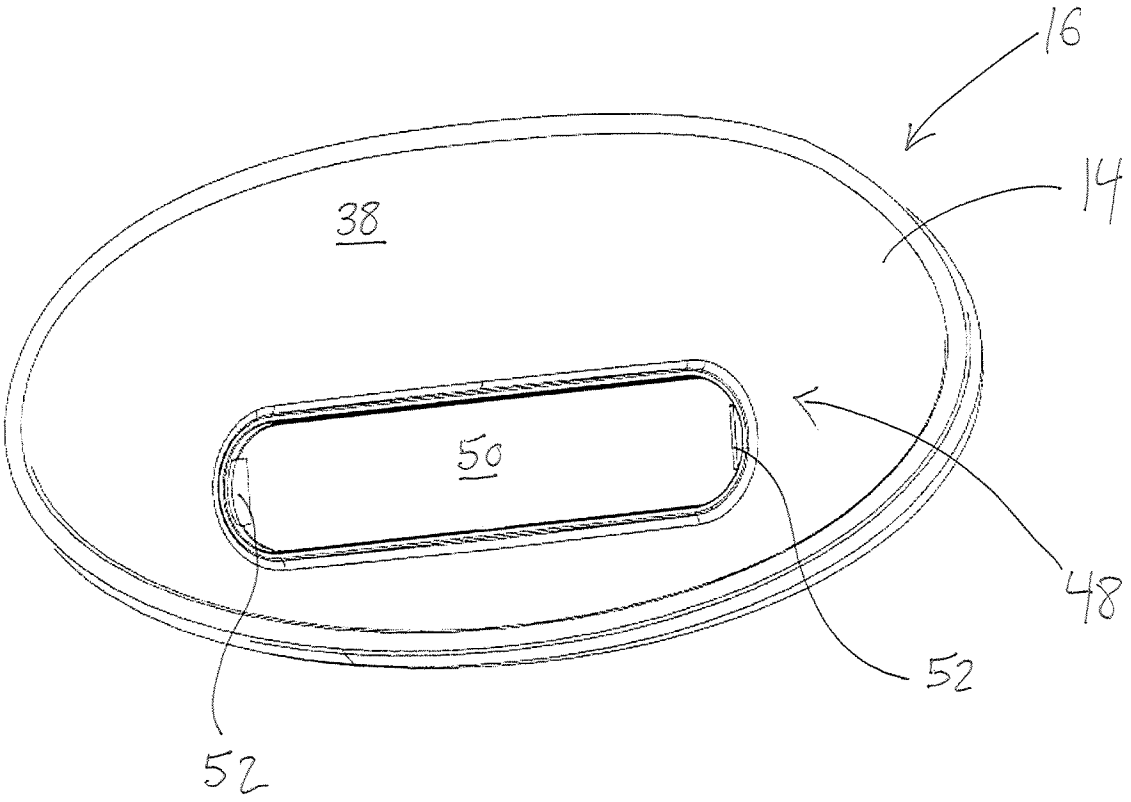
FIG. 13 is a rear view of the subassembly of FIG. 12.
Figure 14D:
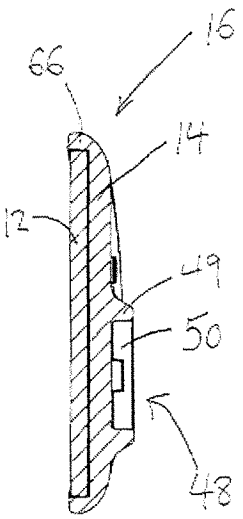
FIG. 14D is a cross-sectional view of the subassembly of FIG. 12 taken along section lines B-B of FIG. 14A.
Figure 14C:
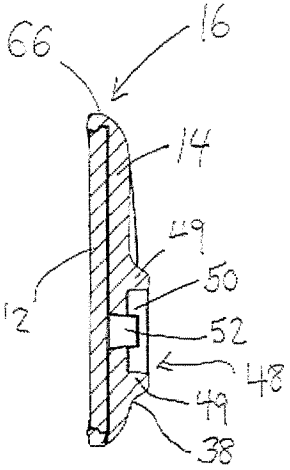
FIG. 14C is a cross-sectional view of the subassembly of FIG. 12 taken along section lines A-A of FIG. 14A.
Figure 14E:
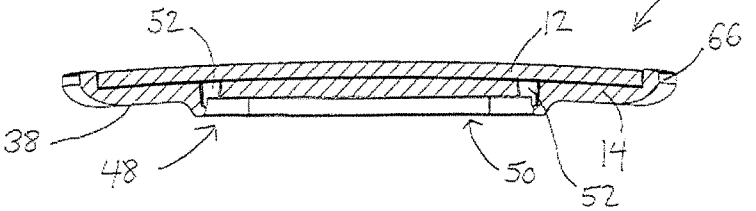
FIG. 14E is a longitudinal sectional view of the subassembly of FIG. 12 taken along section lines C-C of FIG. 14A.
Figure 14A:
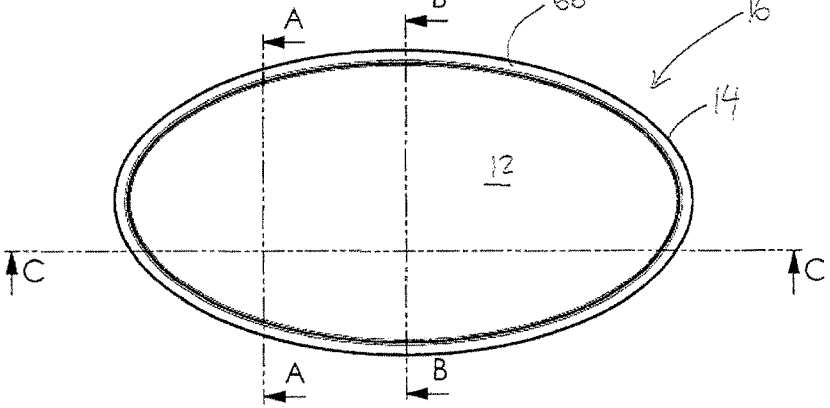
FIG. 14A is a front elevational view of the subassembly of FIG. 12.
Figure 14B:
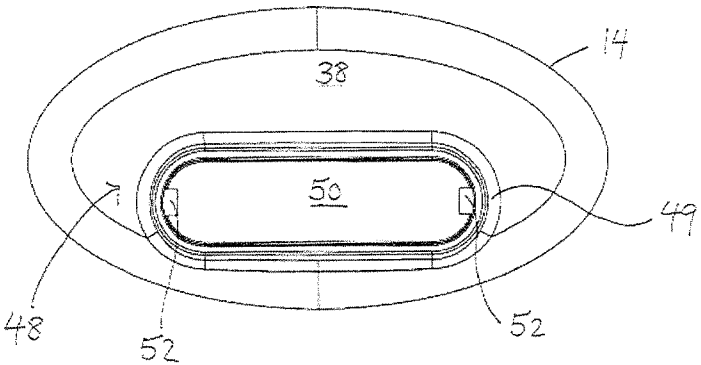
FIG. 14B is a rear elevational view of the subassembly of FIG. 12.

As described herein, display subassembly 16 may be formed in different shapes and sizes depending upon the desired application. FIGS. 12-14 illustrates an embodiment where display subassembly 16 is oval-shaped. As in the embodiment of FIG. 8, cover 12 fits within backer plate 14. For example, a peripheral rim 66 of backer plate 14 may include slot portions 67 for receiving mating tabs 68 formed on the edge of cover 12. Also, as in other embodiments, rear surface 38 of backer plate 14 includes a first connector 48 (FIGS. 13 and 14).

In the illustrated embodiments recess 50 is an oval-shaped female socket having a narrow profile. That is, connector 48 projects only a short distance rearwardly of rear surface 38 of backer plate 14. However, as will be appreciated by a person skilled in the art many other embodiments and arrangements are possible.

Figure 15:
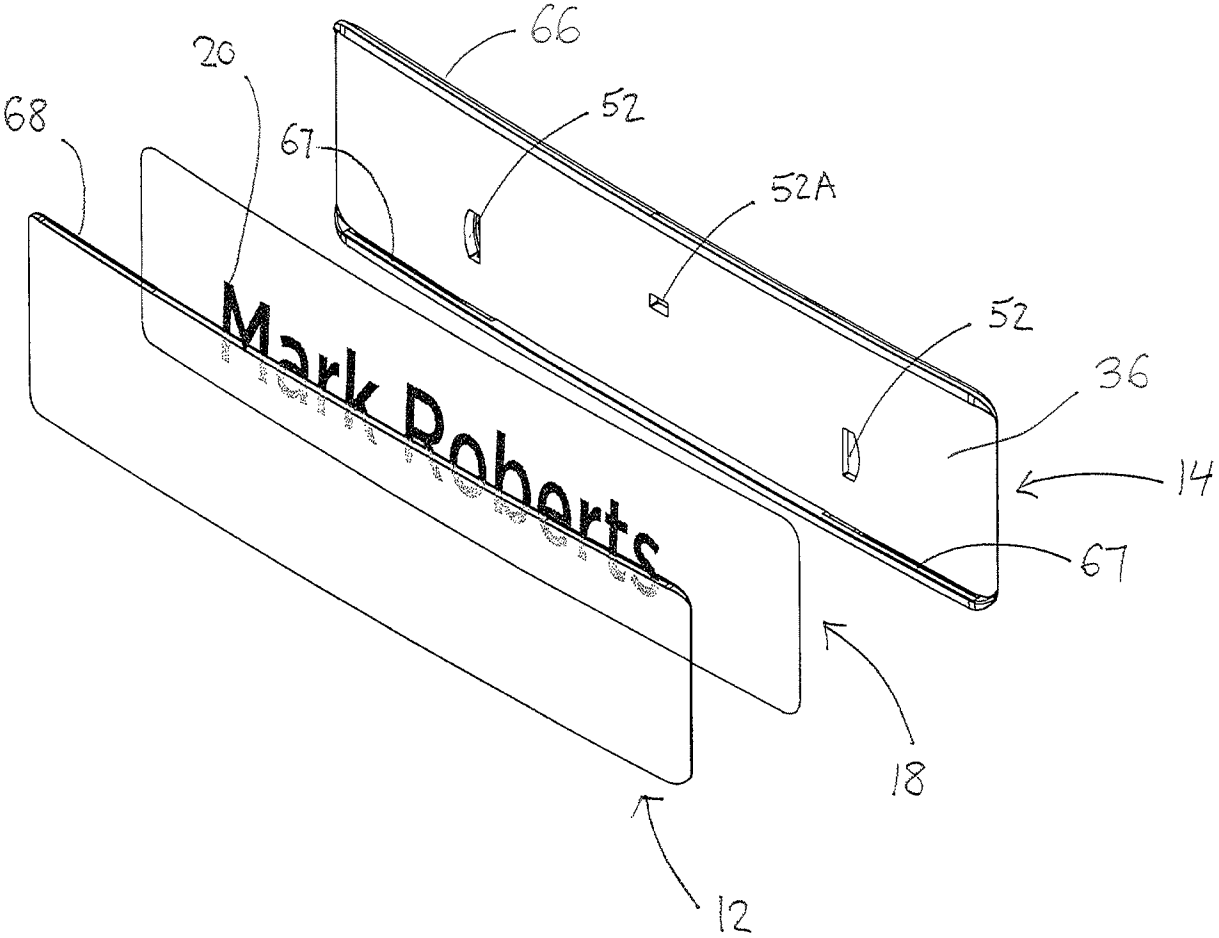
FIG. 15 is an exploded, front perspective view of an embodiment of applicant's display subassembly configured as a rectangular name sign.
Figure 16:
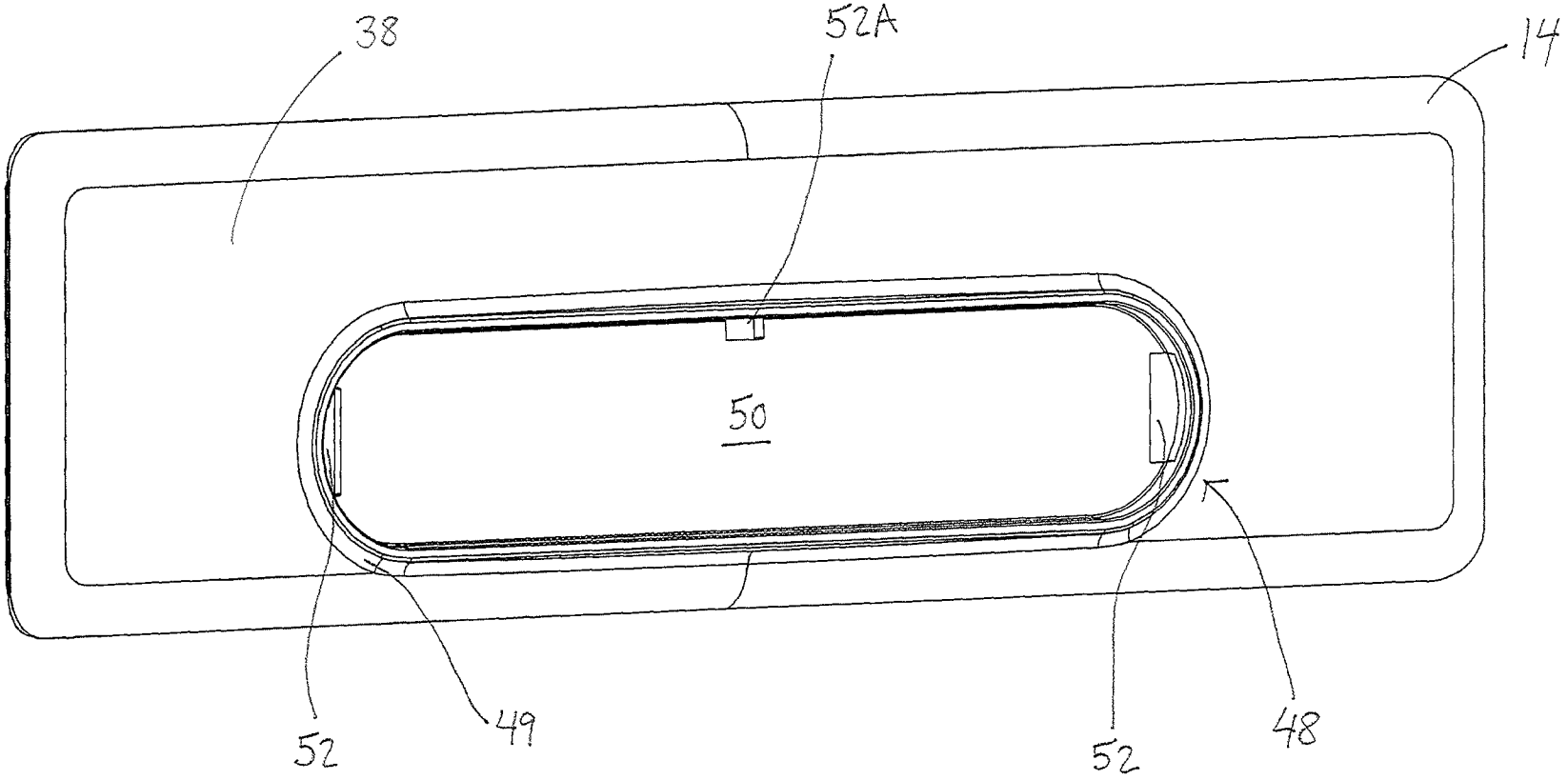
FIG. 16 is a rear view of the subassembly of FIG. 15.
Figure 17E:
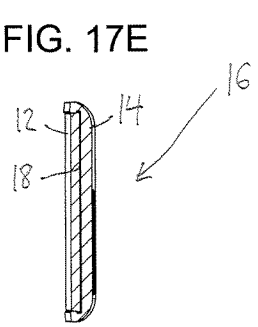
FIG. 17E is a cross-sectional view of the subassembly of FIG. 15 taken along section lines C-C of FIG. 17A.
Figure 17D:
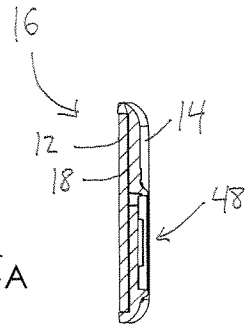
FIG. 17D is a cross-sectional view of the subassembly of FIG. 15 taken along section lines B-B of FIG. 17A.
Figure 17C:
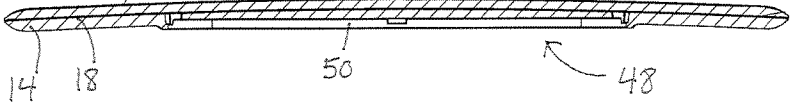
FIG. 17C is a longitudinal sectional view of the subassembly of FIG. 15 taken along section lines A-A of FIG. 17A.
Figure 17A:
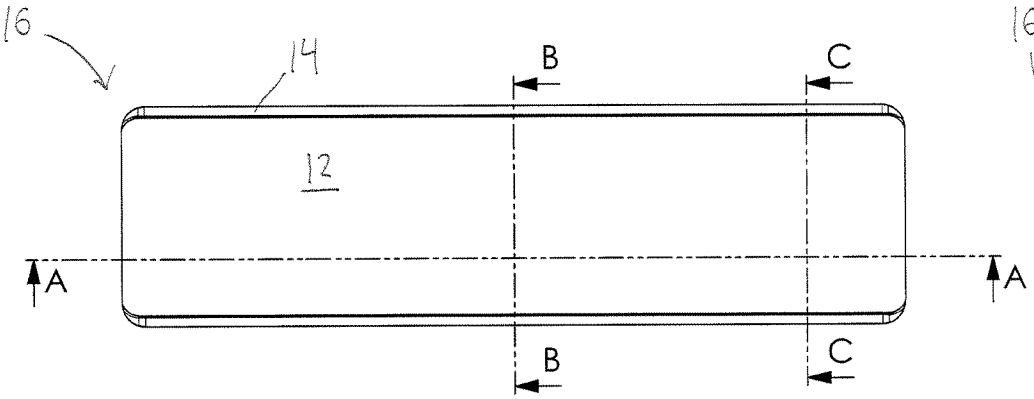
FIG. 17A is a front elevational view of the subassembly of FIG. 15.
Figure 17B:
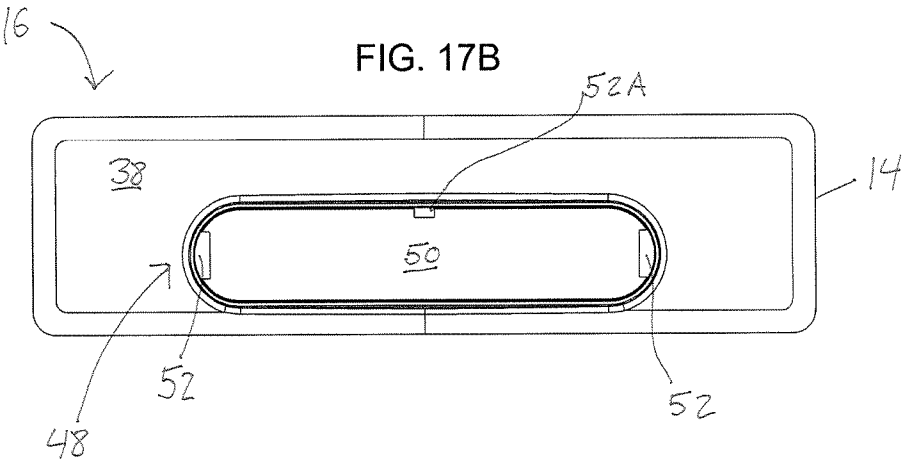
FIG. 17B is a rear elevational view of the subassembly of FIG. 15.

FIG. 15 illustrates another embodiment where display subassembly 16 is configured as a rectangular sign. As in the embodiment of FIG. 8, cover 12 fits within backer plate 14. Also, as in other embodiments, rear surface 38 of backer plate 14 includes a first connector 48 (FIGS. 16 and 17). In this embodiment first connector 48 is proportionately larger in size and recess 50 may comprise one or more additional slots 52A in addition to slots 52. In the illustrated embodiment a single additional slot 52A is located in an upper central portion of recess 50.

Figure 18:
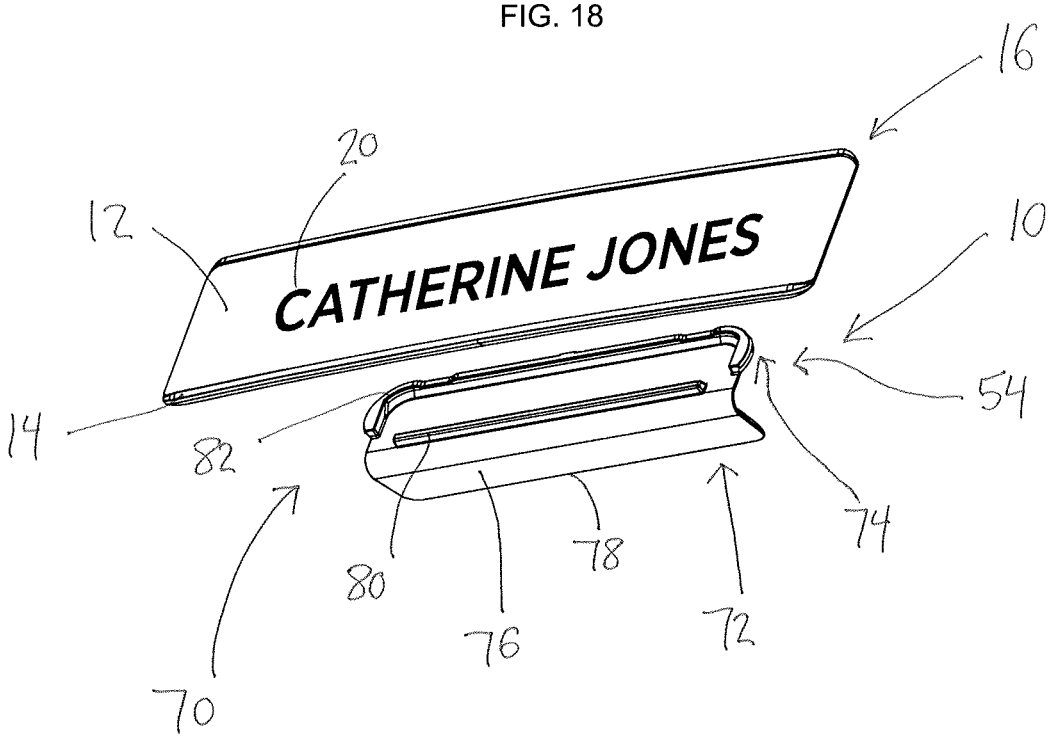
FIG. 18 is an exploded, front perspective view of an embodiment of applicant's display holder comprising the display subassembly of FIG. 15 configured as a desk stand.
Figure 19:
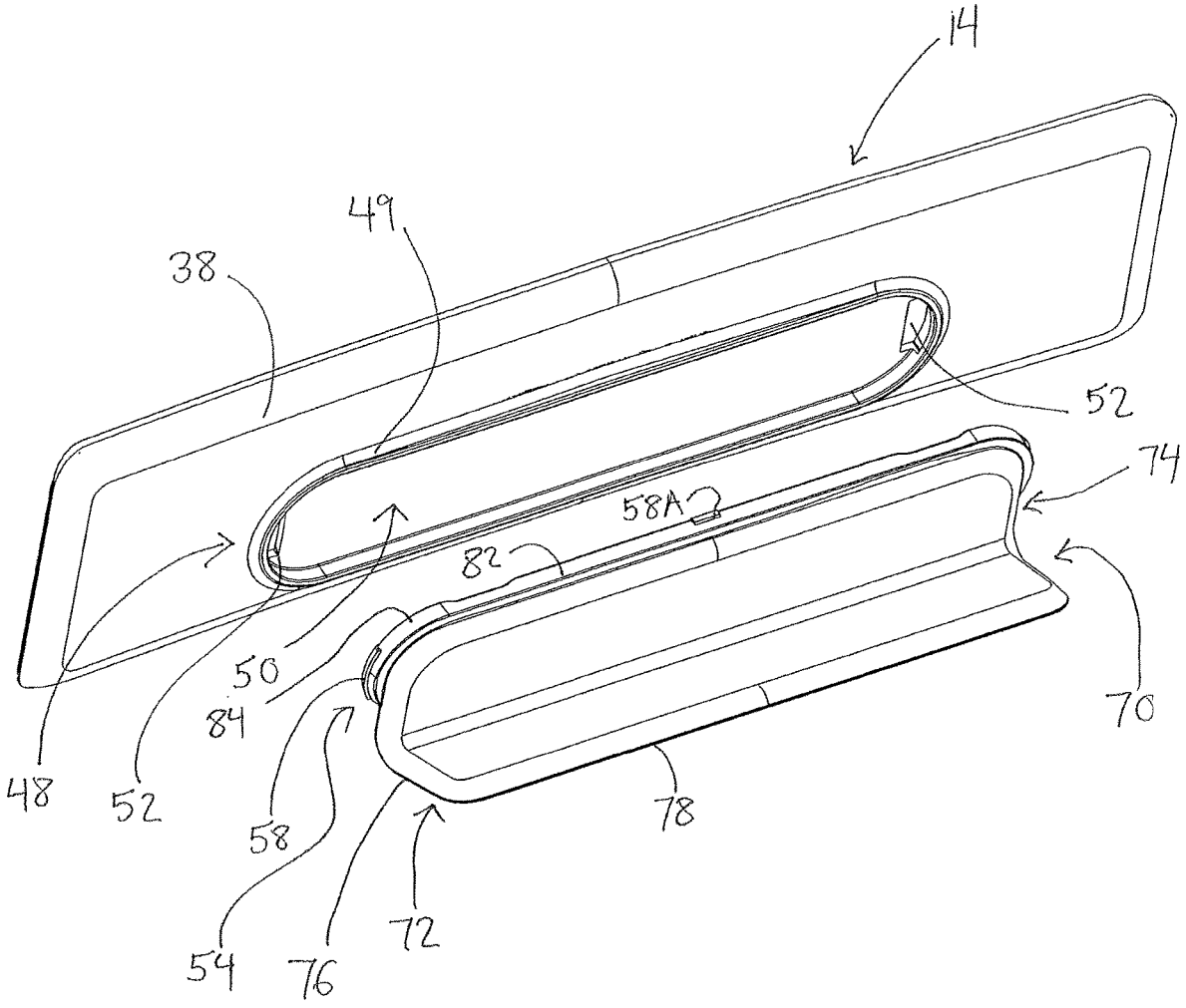
FIG. 19 is an exploded, rear perspective view of the display holder of FIG. 18.
Figure 20:
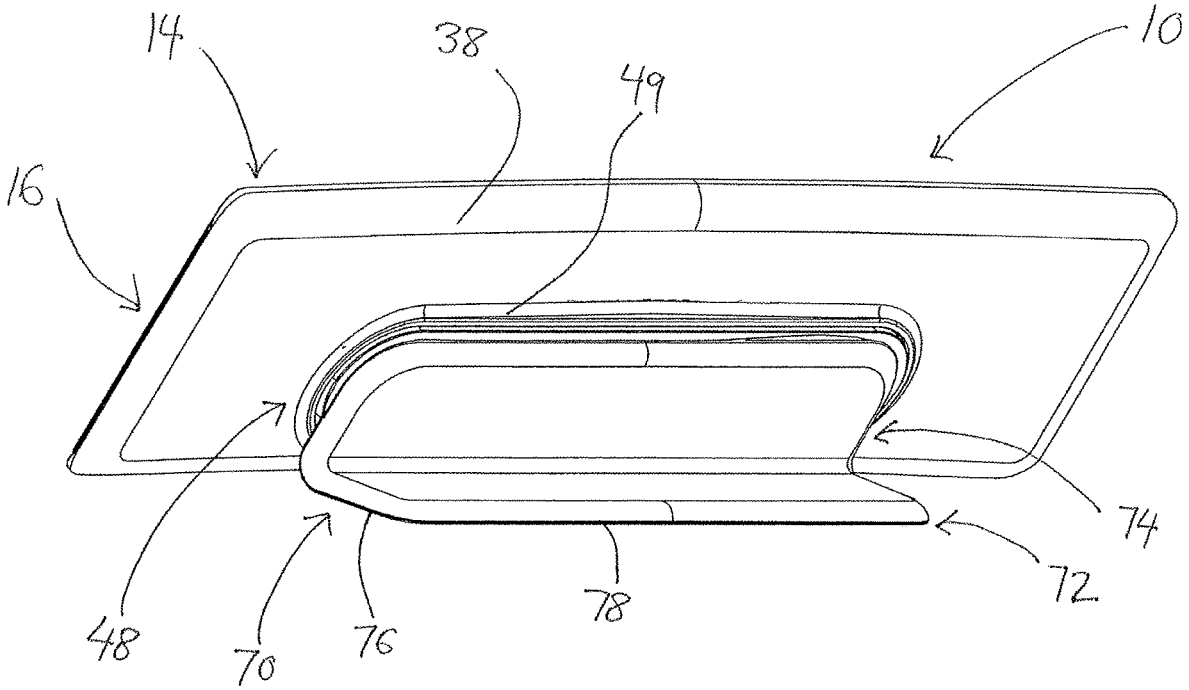
FIG. 20 is a rear, perspective view of a display holder assembled for placement on a support surface in an upright orientation.
Figure 21:
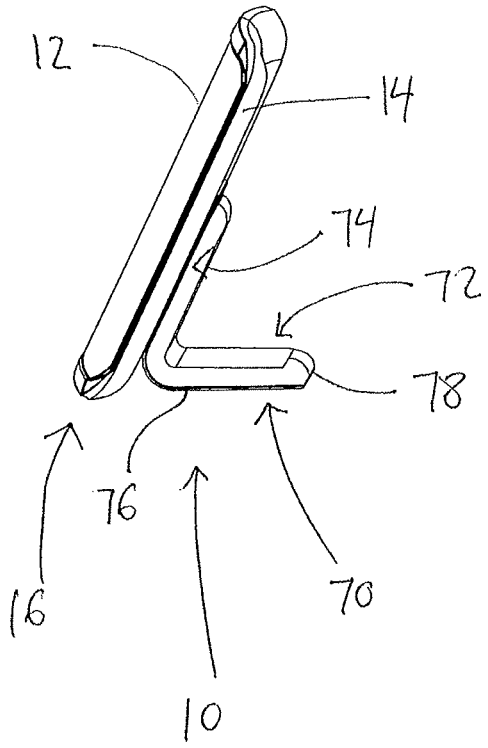
FIG. 21 is a side elevational view of the display holder of FIG. 20.
Figure 22:
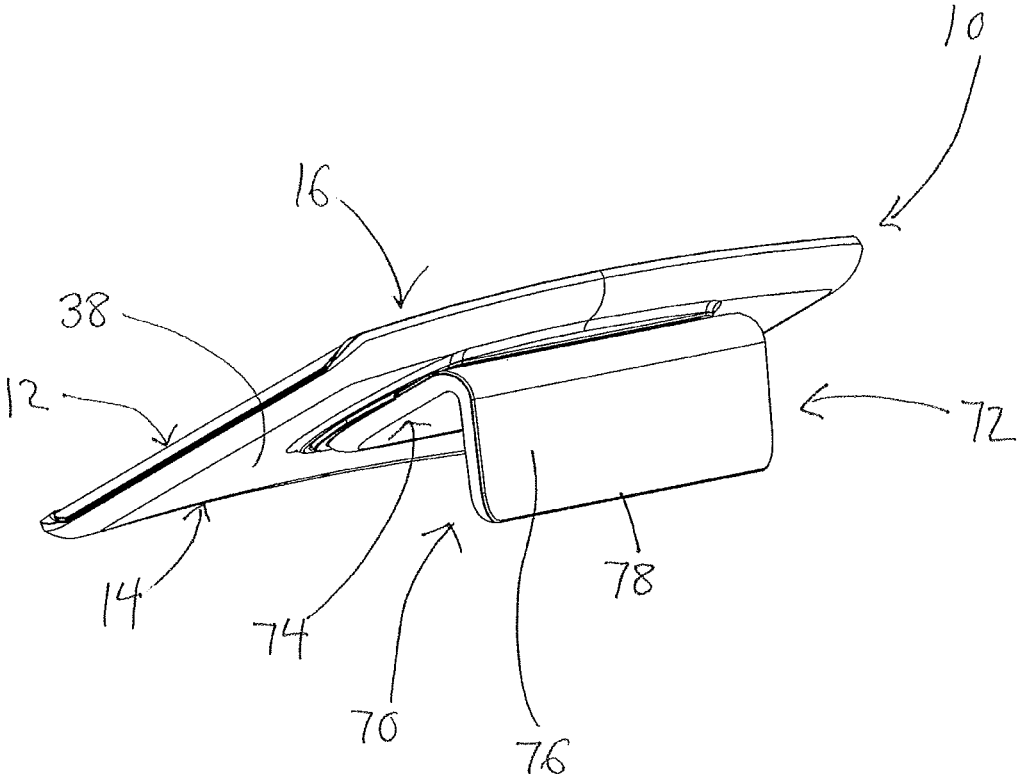
FIG. 22 is a rear, perspective view of the display holder of FIG. 20 assembled for placement on a support surface in an inclined orientation.
Figure 23:
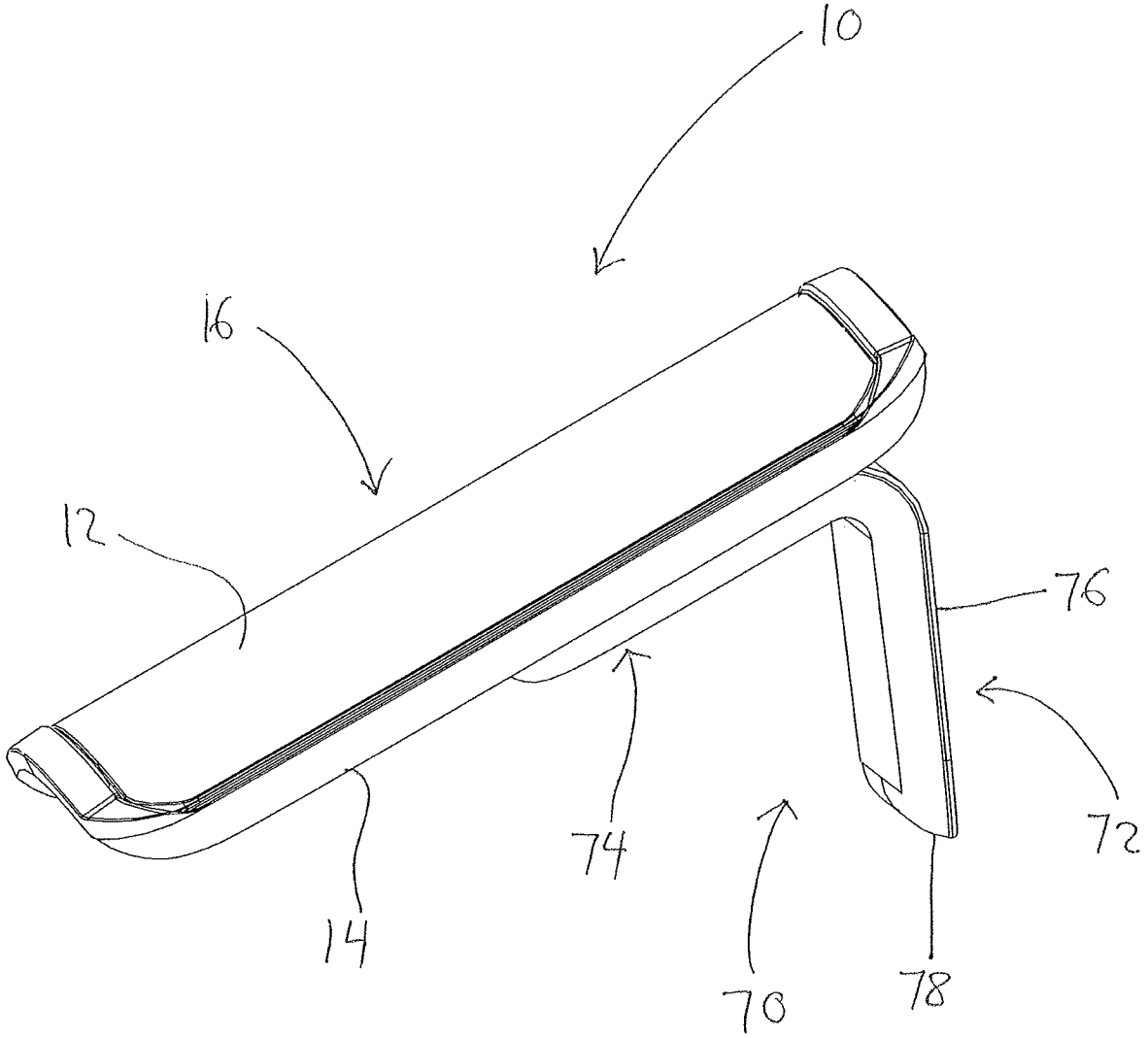
FIG. 23 is a side elevational view of the display holder of FIG. 22.
Figure 24B:
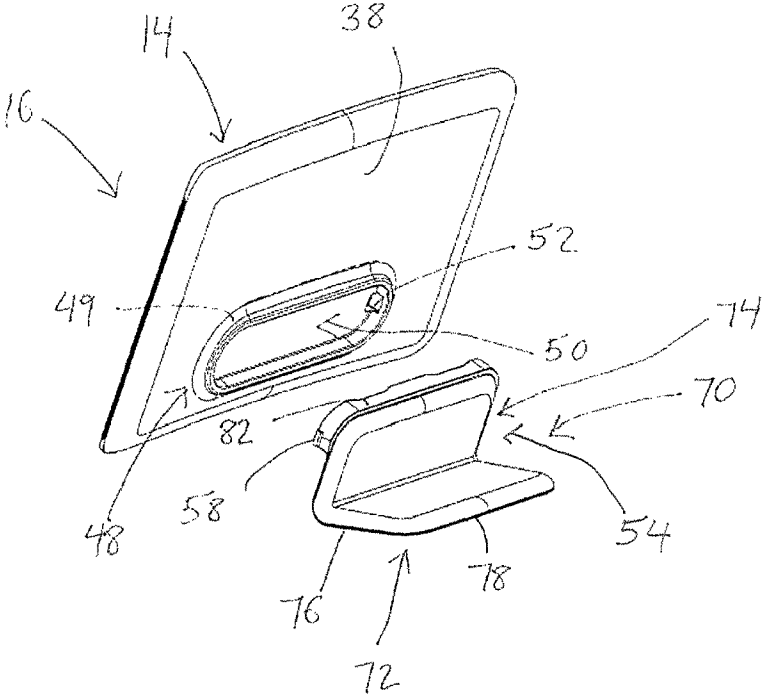
FIG. 24B an exploded, rear perspective view of the display holder of FIG. 24A.
Figure 24A:
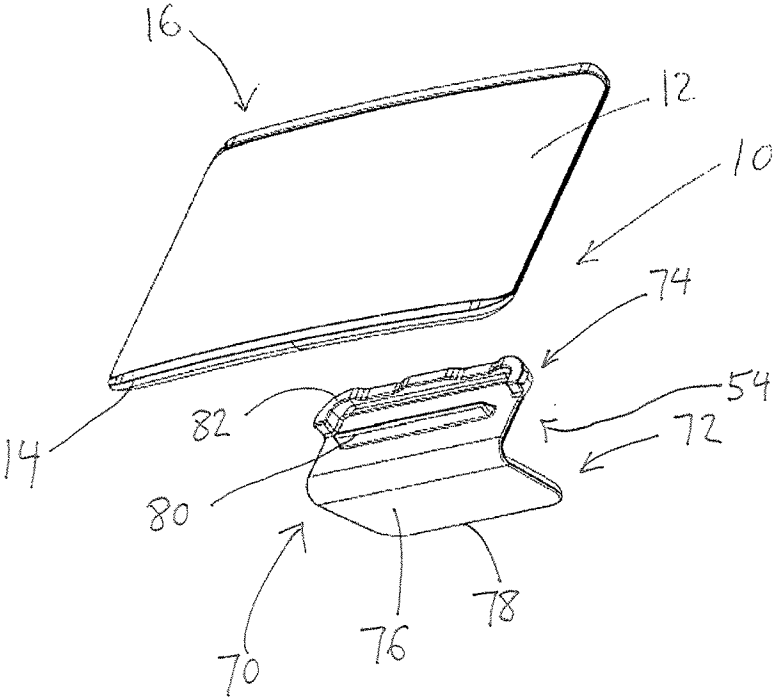
FIG. 24A is an exploded, front perspective view of an embodiment of applicant's display holder configured as an alternative size desk stand in comparison to the embodiment of FIG. 18.
Figure 24D:
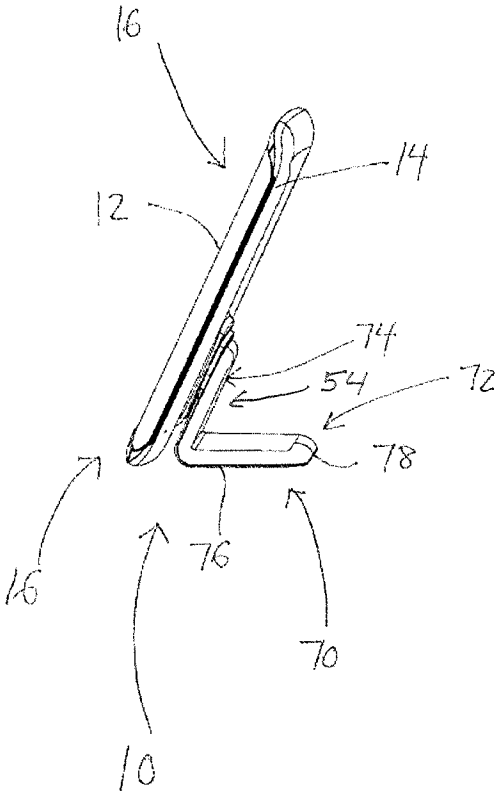
FIG. 24D is a side view of the display holder of FIG. 24C.
Figure 24C:
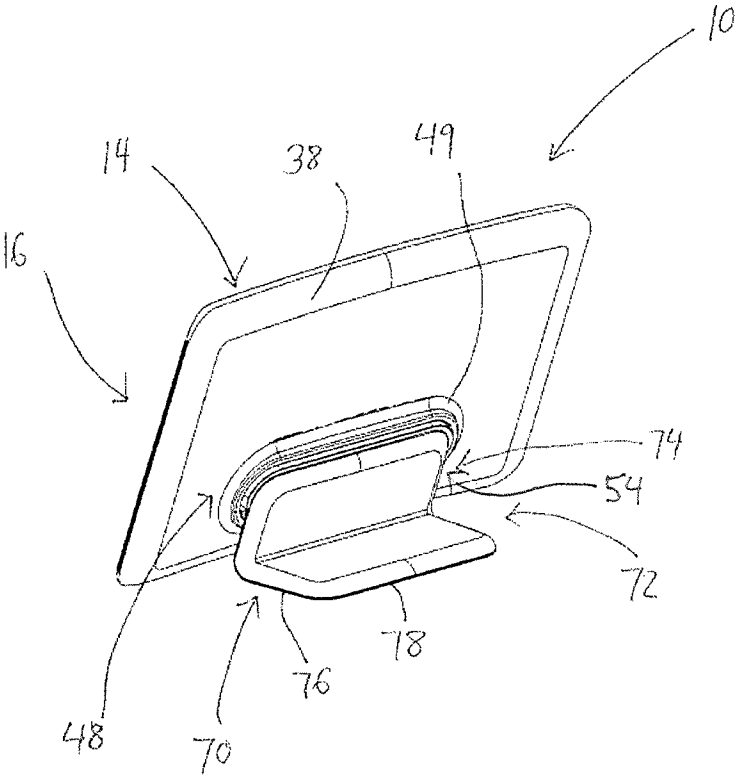
FIG. 24C is a rear, perspective view of the display holder of FIG. 24A assembled for placement on a support surface in an upright orientation.
Figure 24F:
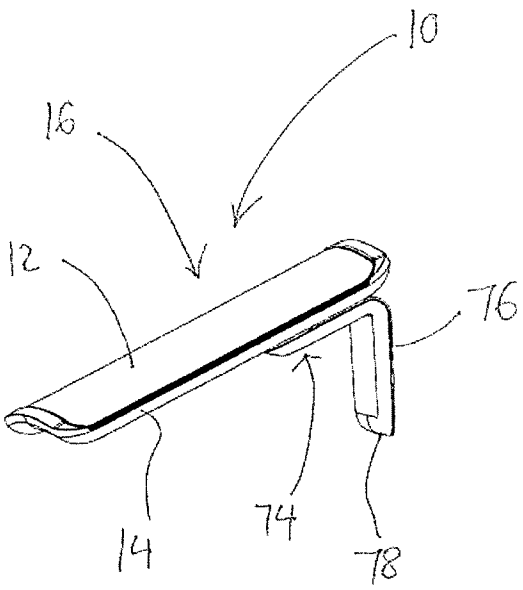
FIG. 24F is a side view of the display holder of FIG. 24E.
Figure 24E:
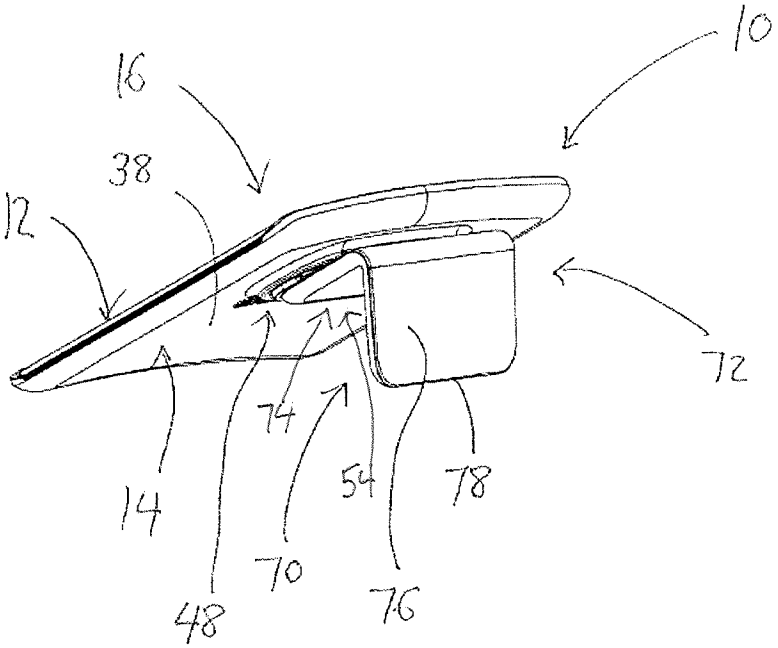
FIG. 24E is a rear, perspective view of the display holder of FIG. 24C assembled for placement on a support surface in an inclined orientation.

As shown in FIGS. 18-24, the display subassembly 16 of FIG. 17 may form part of a display holder 10 configured as a free-standing desk sign. In the desk sign embodiments, holder 10 comprises a stand 70 comprising a base 72 and a mounting surface 74. Stand 70 is generally V-shaped in cross-section. Base 72 comprises a flat surface 76 having one edge connected to mounting surface 74 and free edge 78 remote from mounting surface 74. Stand 70 can be deployed on a desk surface or other support with either flat surface 76 resting on the support (FIG. 18-21) or edge 78 resting on the support (FIGS. 22-23). In the illustrated embodiment mounting surface 74 includes a linear connecting rib 80 proximate base 72 and a rim 82 extending partway along a perimeter edge thereof (FIGS. 18-19). Rim 82 includes rounded corners 84 each having a narrow tab 58 protruding outwardly therefrom. A central tab 58A also projects from a central portion of rim 82.

In this embodiment mounting surface 74 of stand 70 functions as a second connector 54 releasably connectable to first connector 48 of backer plate 14 by means of a snap-fit. In particular, mounting surface 74 is configured to releasably fit into recess 50 of connector 48 such that tabs 58 projecting from corners 84 are seated in slots 52 and central tab 58A is received within slot 52A (FIGS. 18-19). When first and second connectors 48, 54 are coupled together as aforesaid, connecting rib 80 bears against an edge portion of rib 49 of first connector 48.

FIGS. 24A-F illustrate a display holder 10 configured as a free-standing desk sign where the sign is an alternative size than the embodiment of FIGS. 18-19. As will be appreciated by a person skilled in the art, desk signs and other structures for supporting subassembly 16 to form a display holder 10 may be deployed in many different shapes and sizes.

FIGS. 25-28 illustrate another embodiment of display holder 10 comprising an alternative stand 86 for deploying cover assembly 16 on a support. In this embodiment stand 86 is adapted to optionally support one or two display assemblies 16. For example, stand 86 could be placed on a divider between two adjacent work stations to separately identify the occupant of each work station.

Figure 25:
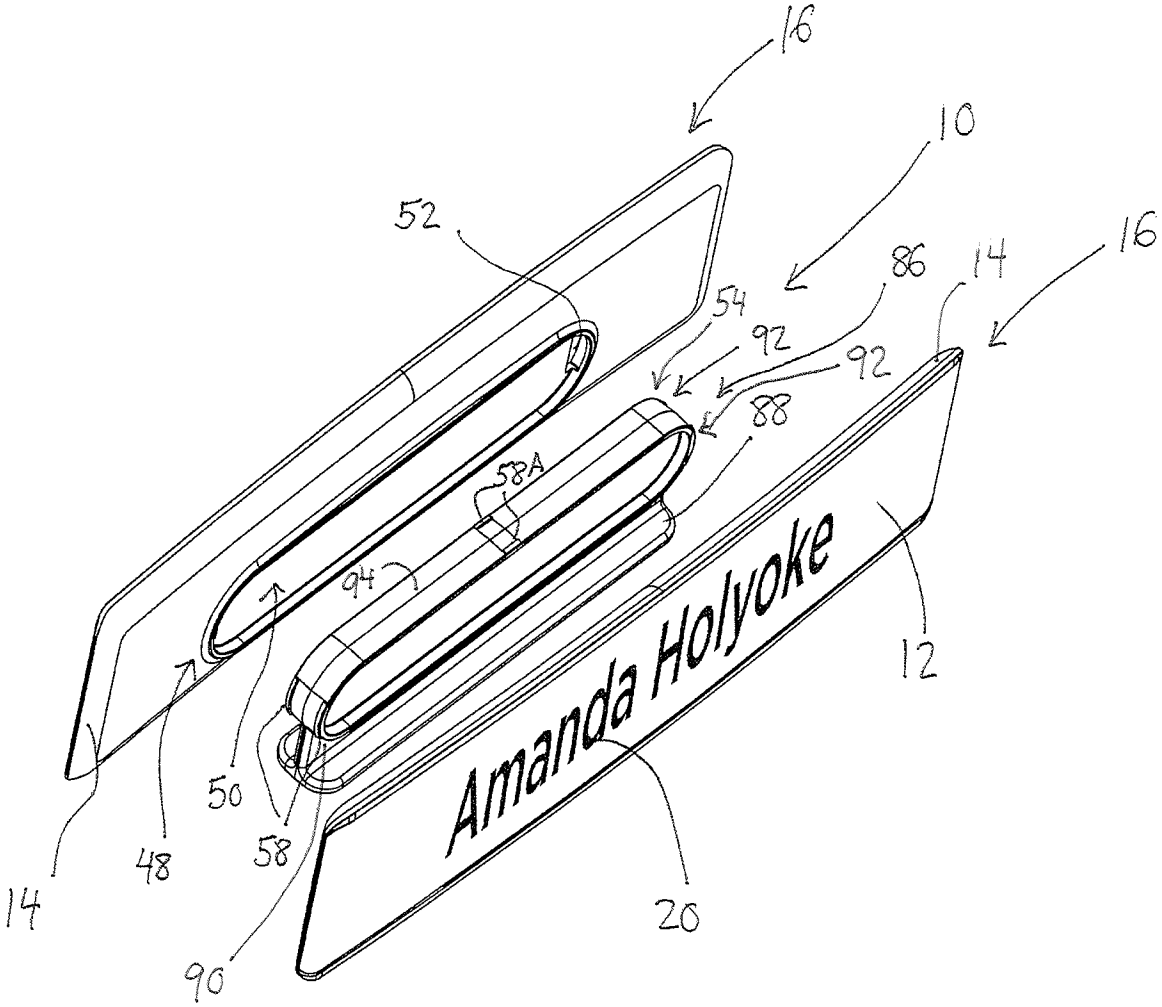
FIG. 25 is an exploded, perspective view of an embodiment of applicant's display holder comprising the display subassembly of FIG. 15 configured as a divider stand.
Figure 26:
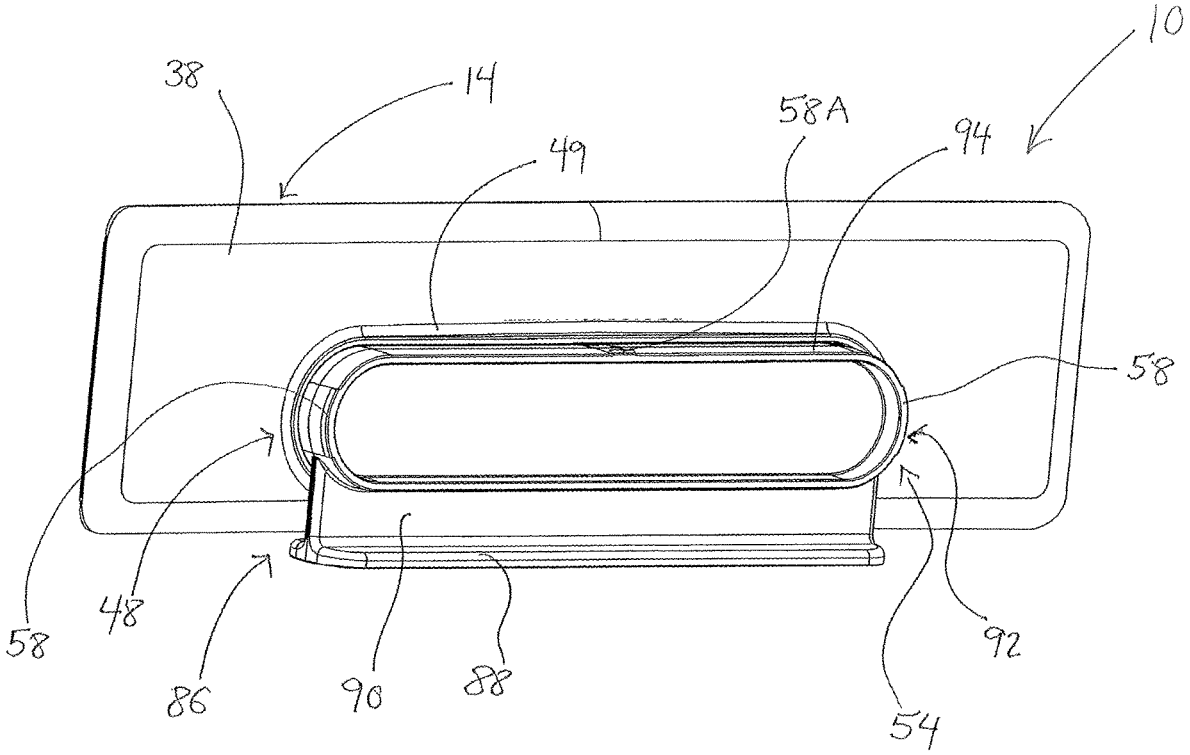
FIG. 26 is a perspective view of the display holder of FIG. 25 partially assembled showing one display subassembly mounted on the divider stand.
Figure 27:
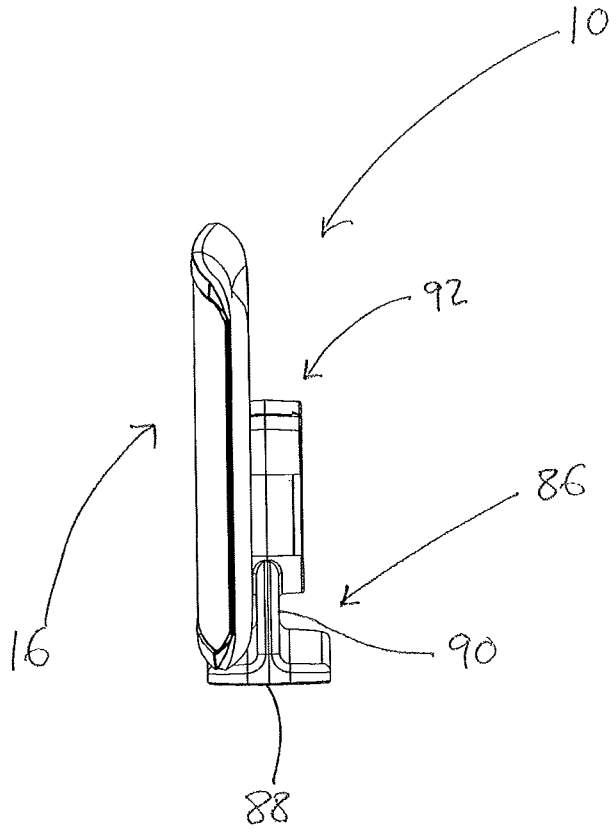
FIG. 27 is a side elevational view of the display holder of FIG. 26.
Figure 28:
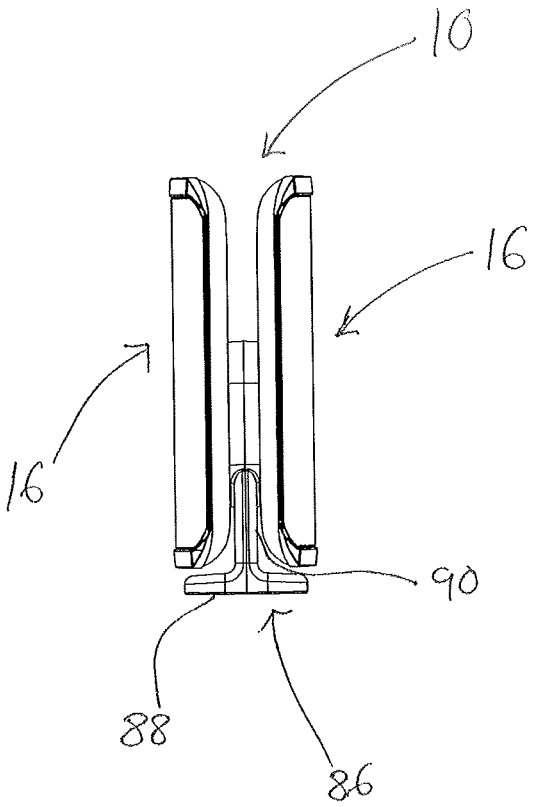
FIG. 28 is a side elevational view of a display holder according to FIG. 25 with two display subassemblies mounted on the divider stand.

As shown in exploded view in FIG. 25, divider stand 86 may be formed as one integral unit. Alternatively stand 86 may be formed from two interconnectible halves. Stand 86 includes a base 88 and a support plate 90 extending perpendicular to base 88. A pair of mounting surfaces 92 disposed in parallel planes are mounted on support plate 90. Each mounting surface 92 includes a peripheral rim 94 which is sized and shaped to fit within recess 50 of first connector 48. A plurality of tabs 58, 58A may be formed on rim 94. Accordingly, in this embodiment each mounting surface 92 functions as a second connector 54 releasably connectable to first connector 48 of backer plate 14 by means of a snap-fit, e.g. whereby tabs 58, 58A are received in corresponding slots 52, 52A.

Base 88 of divider stand 86 may be free-standing or may be secured to a support surface, such as a work station divider, using double-sided tape or the like. Stand 86 may be used to optionally support one (FIGS. 26-27) or two (FIG. 28) display subassemblies 16. Each display subassembly 16 may be the same or different. Thus the two subassemblies 16 mounted on divider stand 86 do not necessarily need to be identical in size and/or shape.

Figure 29:
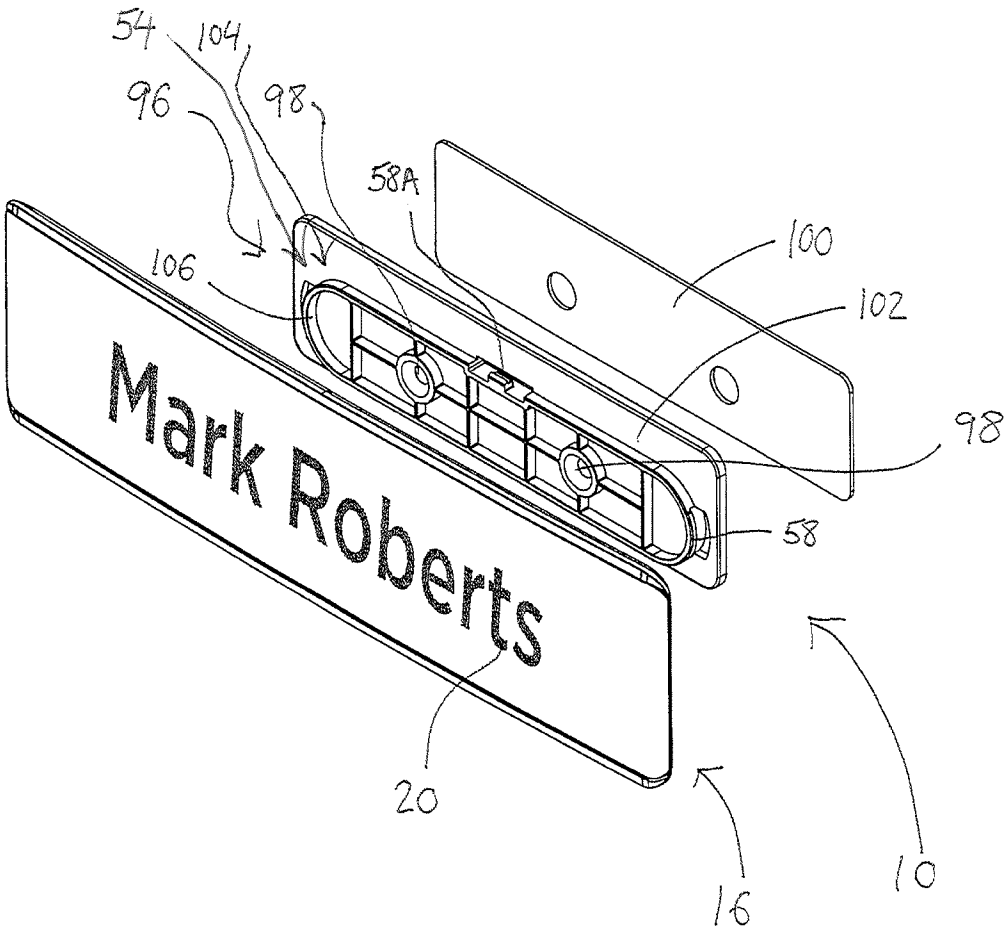
FIG. 29 is a front, perspective view of an embodiment of a display holder for mounting the display subassembly of FIG. 15 on a wall or door.
Figure 30:
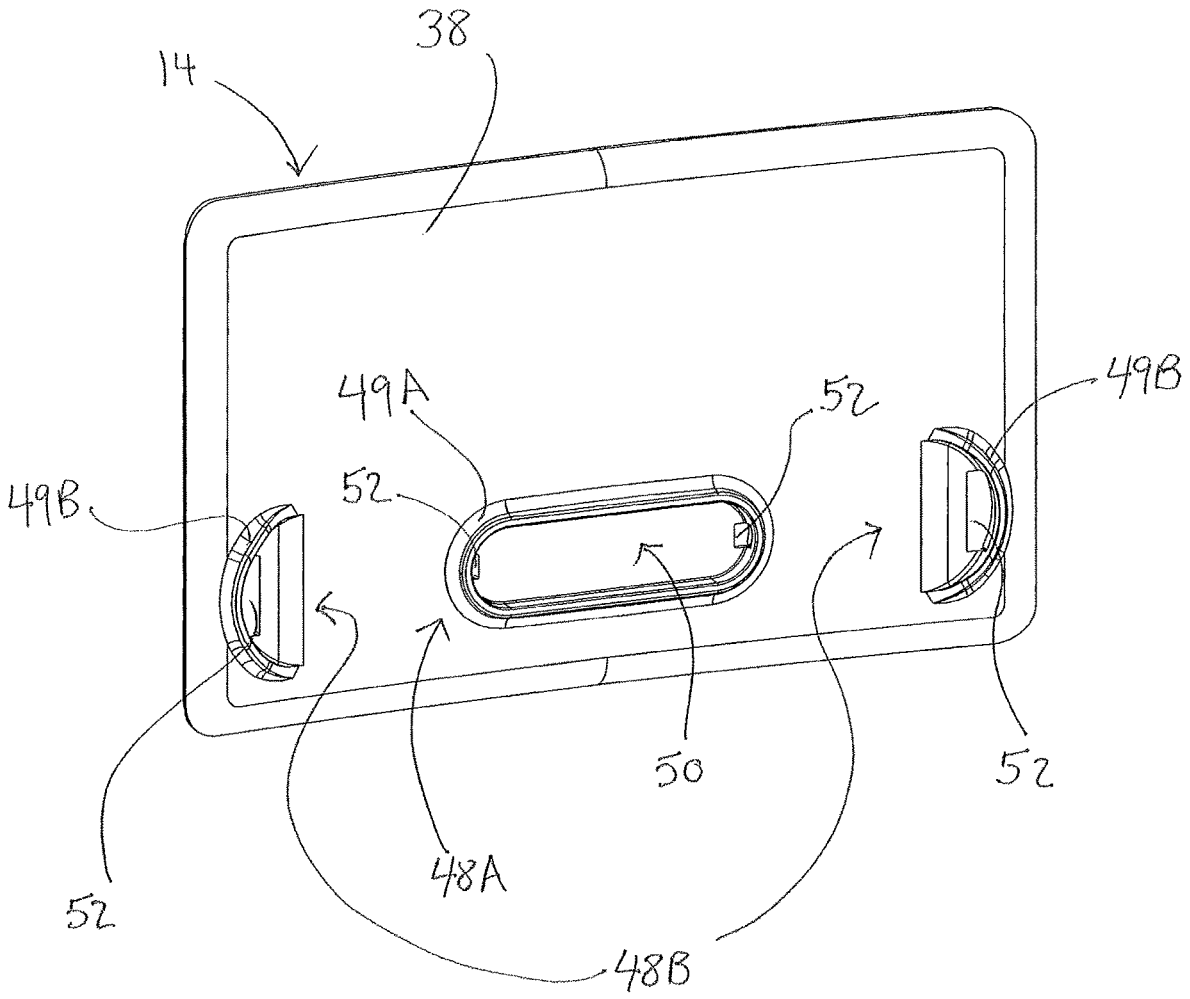
FIG. 30 is a rear perspective view of a display subassembly comprising an alternative backer plate having two first connectors of differing sizes.
Figure 31D:
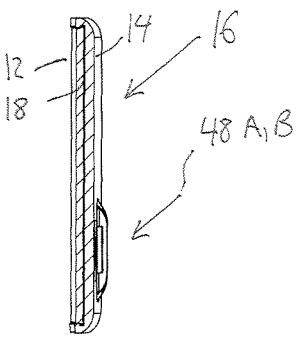
FIG. 31D is a cross-sectional view of the subassembly of FIG. 30 taken along section lines B-B of FIG. 31A.
Figure 31C:
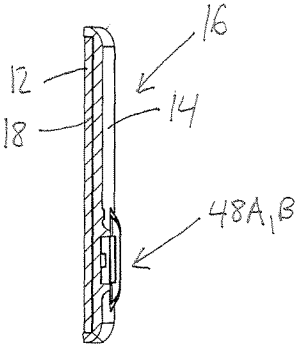
FIG. 31C is a cross-sectional view of the subassembly of FIG. 30 taken along section lines A-A of FIG. 31A.
Figure 31A:
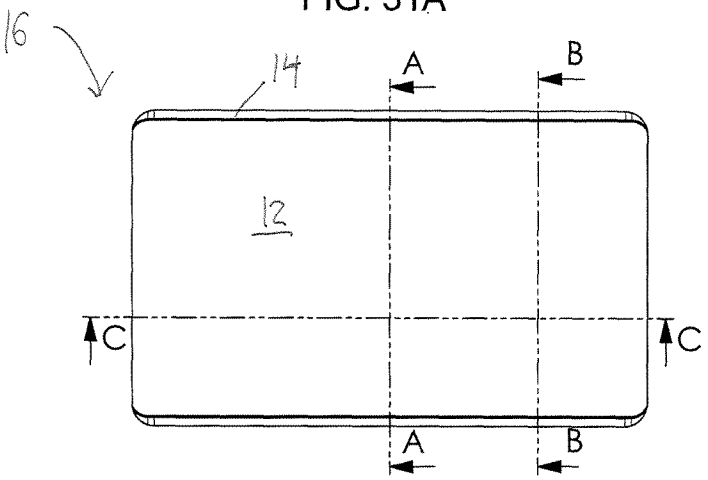
FIG. 31A is a front elevational view of the subassembly of FIG. 30.
Figure 31E:
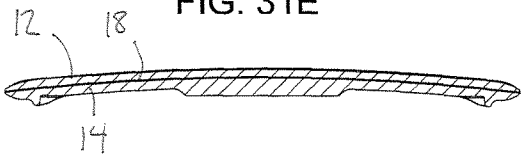
FIG. 31E is a longitudinal sectional view of the subassembly of FIG. 30 taken along section lines C-C of FIG. 31A.
Figure 31B:
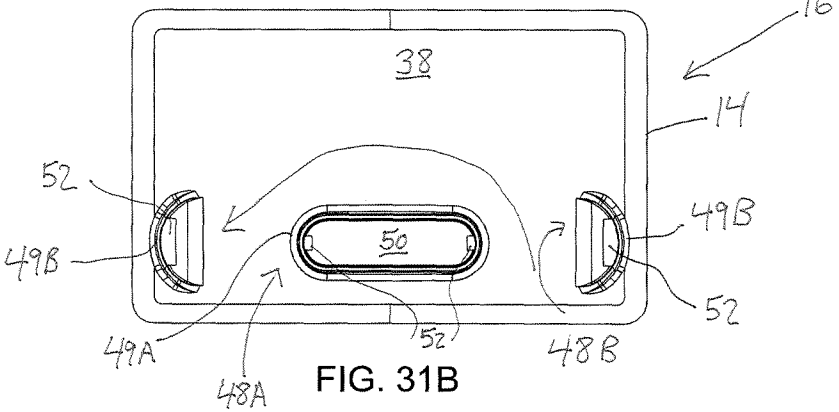
FIG. 31B is a rear elevational view of the subassembly of FIG. 30.

FIG. 29 illustrates an embodiment of display holder 10 for positioning display subassembly 16 on a fixed vertical surface, such as a wall or door. In this embodiment display holder 10 comprises a mounting plate 96. Plate 96 includes apertures 98 for receiving fasteners (not shown) to secure plate 96 to a support structure. Alternatively, plate 92 could be secured to a support using double-side tape 100. Plate 96 includes a flat surface 102 for attachment to the support and a raised mounting surface 104 comprising a peripheral rim 106 which is sized and shaped to fit within recess 50 of first connector 48. As in other embodiments, a plurality of tabs 58, 58A may be formed on rim 106. Accordingly, in this embodiment each mounting surface 104 functions as a second connector 54 releasably connectable to first connector 48 of backer plate 14 by means of a snap-fit, e.g. whereby tabs 58, 58A are received in corresponding slots 52, 52A.

Figure 32:
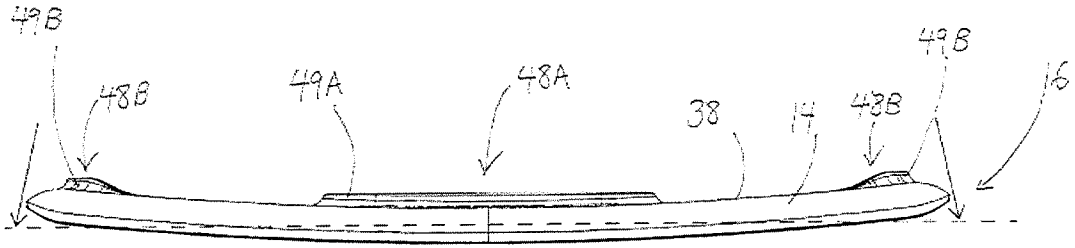
FIG. 32 is a top plan view of the display subassembly of FIG. 30 showing its adjustability between rest and flexed orientations.
Figure 33:
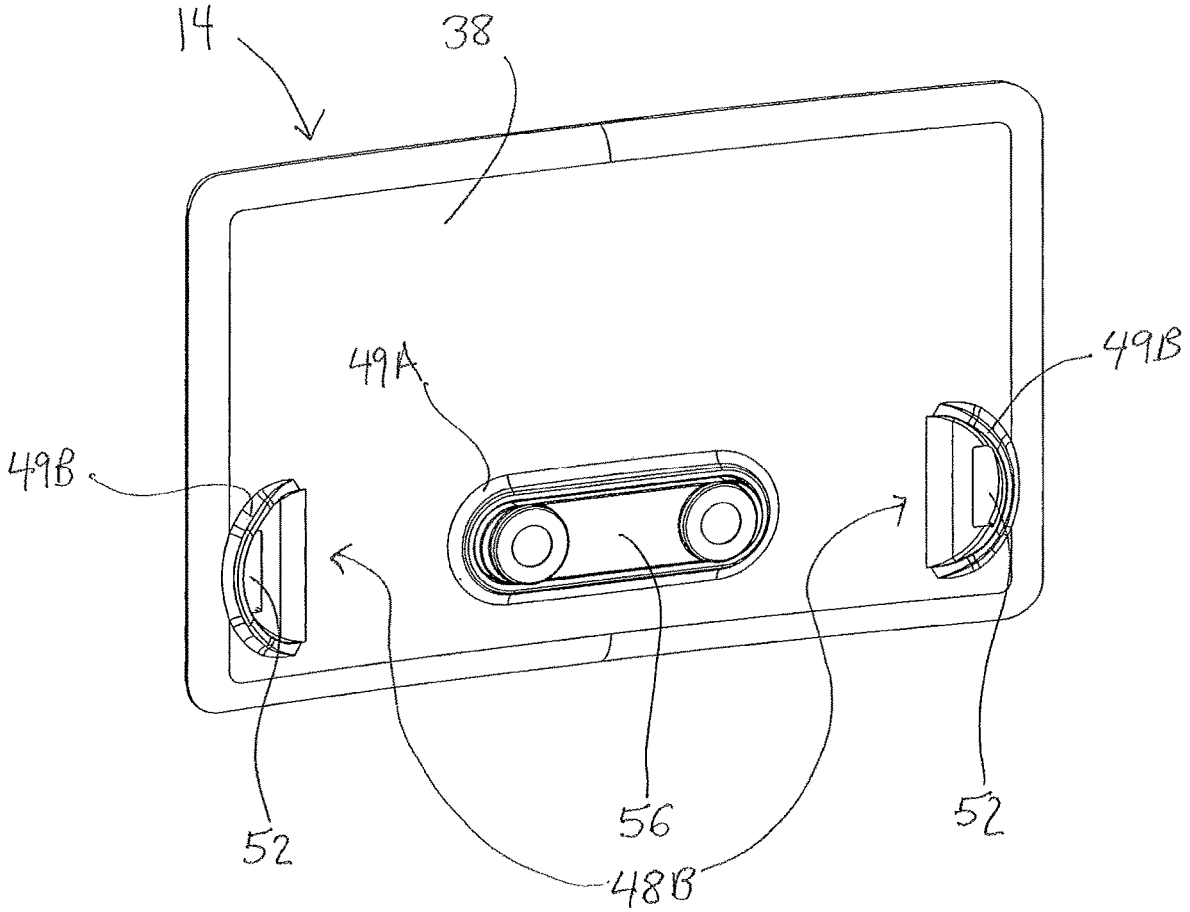
FIG. 33 is a rear perspective view of the subassembly of FIG. 30 showing a magnet accessory coupled to one of the first connectors.
Figure 34:
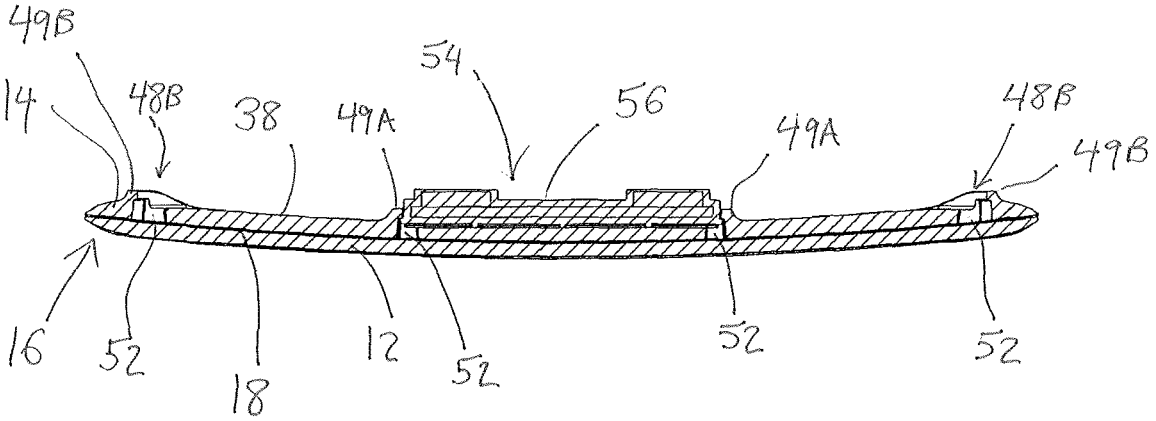
FIG. 34 is a longitudinal sectional view of the assembly of FIG. 33.

FIGS. 30-34 illustrate a further alternative embodiment which comprises dual first connectors 48 formed on rear surface 38 of a backer plate 14. More particularly, a relative small first connector 48A is disposed within the interior of a relatively large first connector 48B. Unlike the embodiment of FIG. 16, for example, recess 50 of first connector 48B is defined by a partial rim 49B rather than a continuous rim 49A. However, slots 52 are formed adjacent the rim portions 49B. This embodiment has the advantage that different second connectors 54 of different sizes can be releasably coupled to backer plate 14. For example, a magnet accessory 56 may be connected to connector 48A (FIGS. 33-34). Alternatively, magnet accessory 56 could be removed and backer plate could be coupled to a stand 70 in the same manner as illustrated in FIGS. 18-19. FIG. 32, similar to FIG. 11, shows how display subassembly 16 may flex in the direction of the arrows from a slightly curved orientation to an approximate planar orientation. As discussed above, this flexing enables second connector 54 to be quickly and easily decoupled from first connector 48 by users without the need for any special tools or techniques.

Figure 35:
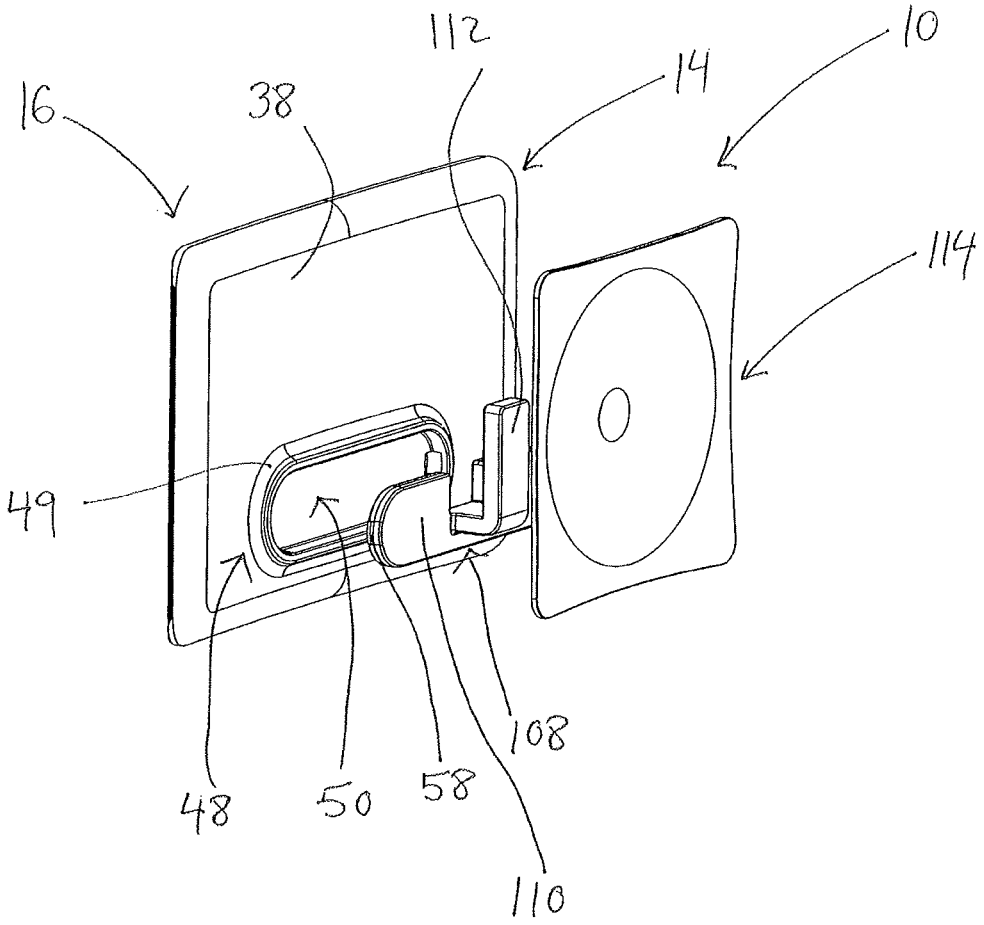
FIG. 35 is an exploded rear, perspective view of an embodiment of a display holder for positioning a display subassembly on a support surface using a suction accessory.
Figure 36:
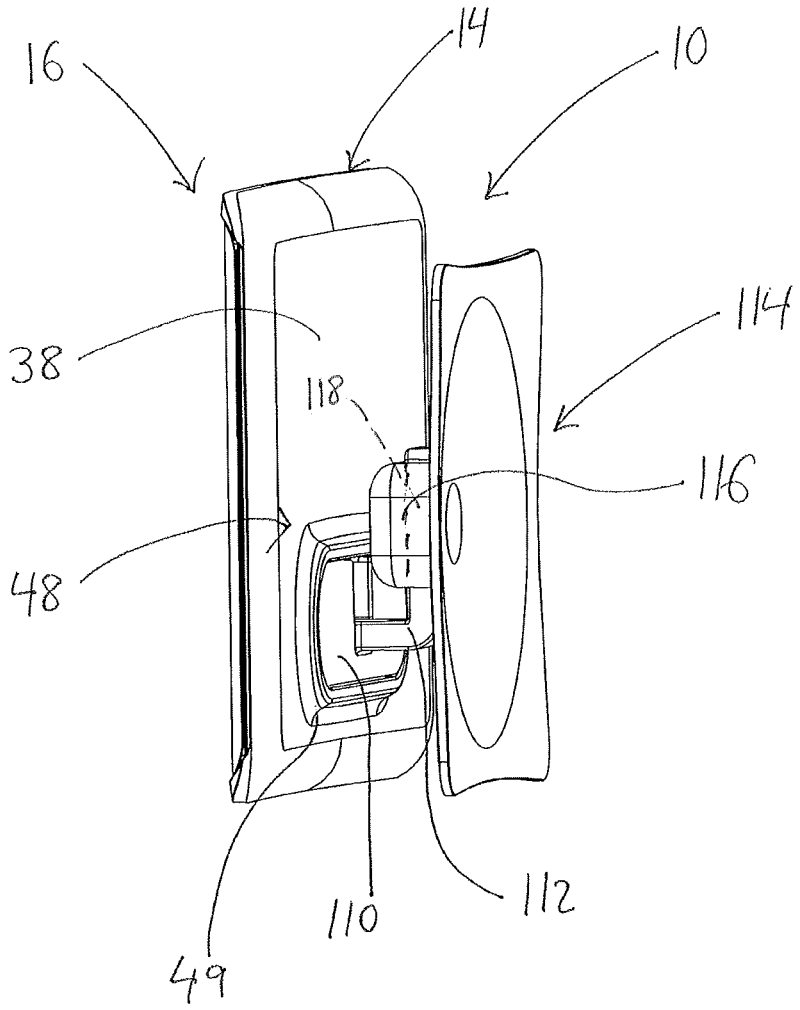
FIG. 36 is a side perspective view of the display holder of FIG. 35 in an assembled configuration.

In other embodiments of display holder 10, a display subassembly 16 may be secured to a support surface, such as a glass display, by suction forces. FIG. 35 illustrates a second connector 54 configured as a suction cup support 108. Support 108 comprises a mounting surface 110 having tabs 58 formed on edges thereof. Mounting surface 110 is sized to fit within recess 50 of first connector 48 such that tabs 58 are received in mating slots 52. Mounting surface 110 supports a central post 112 for supporting a suction accessory 114. A suitable suction accessory 114 is the disclosed in U.S. Pat. No. 5,964,437 the disclosure of which is hereby incorporated by reference in its entirety. Such accessory 114 includes a stem connector 116 have an aperture 118 formed therethrough. As shown in FIG. 36, post 112 is removably insertable through aperture 118 to couple suction cup support 108 to suction accessory 114. In use, suction accessory 114 can be secured to a glass surface, such as a buffet stand, to mount display holder 10 at the desired location.

When used in buffet applications and the like, there is a likelihood that food or beverages may occasionally spill on display holder 10 as discussed above. An important advantage of this embodiment is that all of the component parts are foodsafe and dishwasher safe. Thus, after each use to, for example, identify food items in a buffet, display holders 10 can be easily disassembled, washed/sterilized and reused. This enables serving staff to quickly and economically set out and remove attractive buffet signage while complying with health regulations. Moreover, since the component parts of the applicant's display holder system are engineered to be mechanically robust, display holders 10 are not prone to breakage, even when reused many times.

Figure 37A:
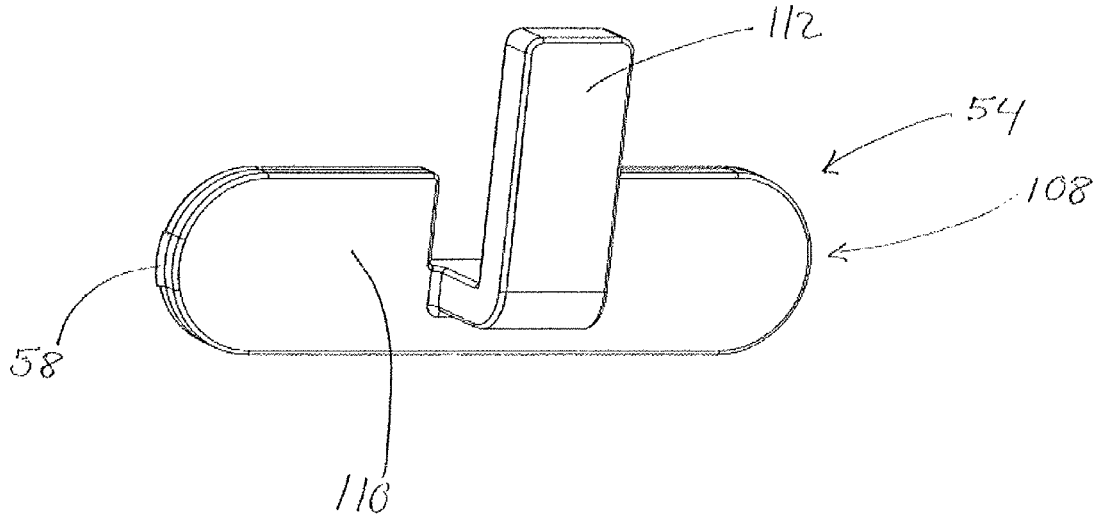
FIGS. 37A and 37B are rear and front perspective views respectively of an embodiment of a suction support connector.
Figure 37B:
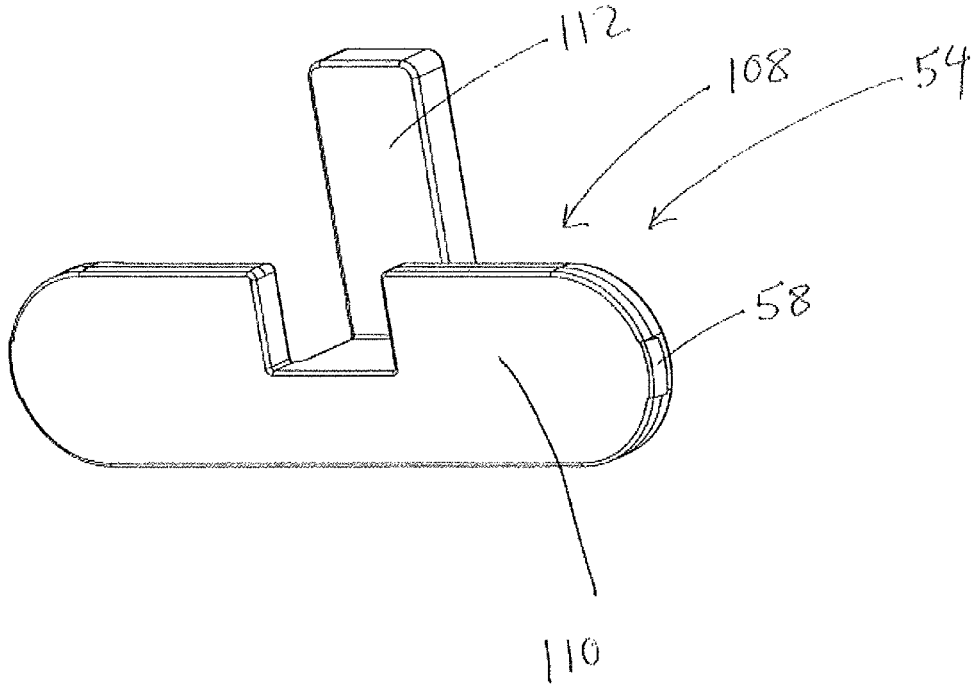
Figure 38A:
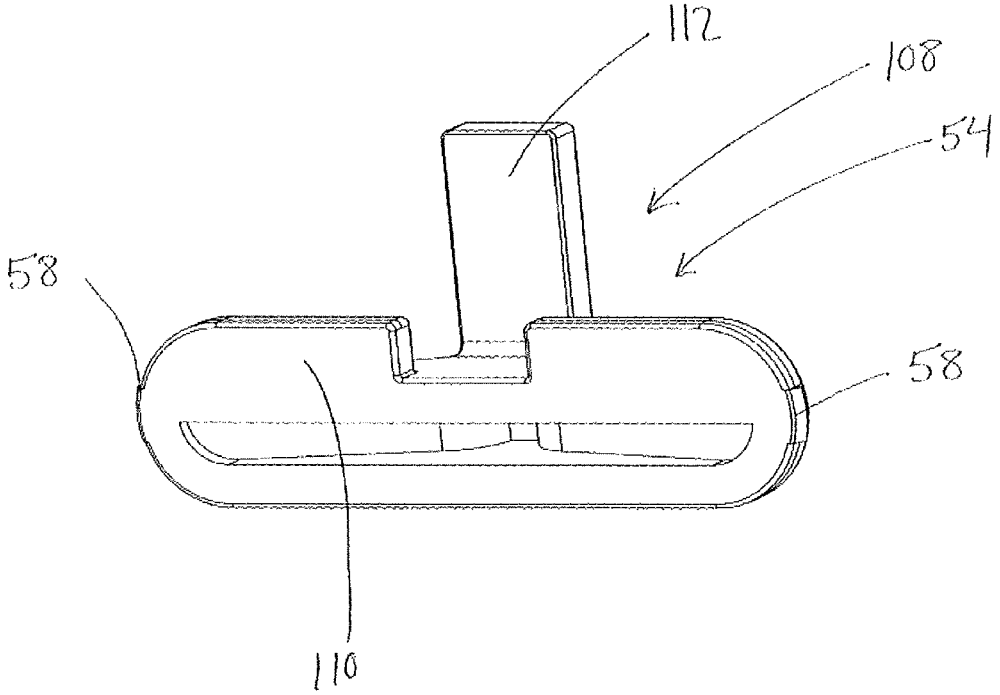
FIGS. 38A and 38B are rear and front perspective views respectively of an alternative embodiment of a suction support connector.
Figure 38B:
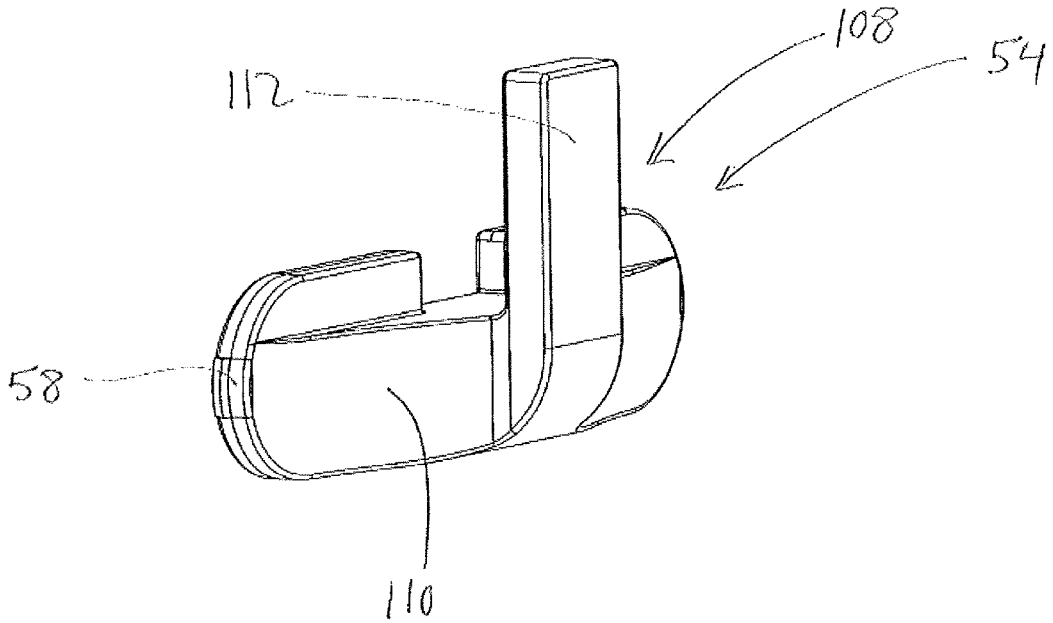
Figure 39A:
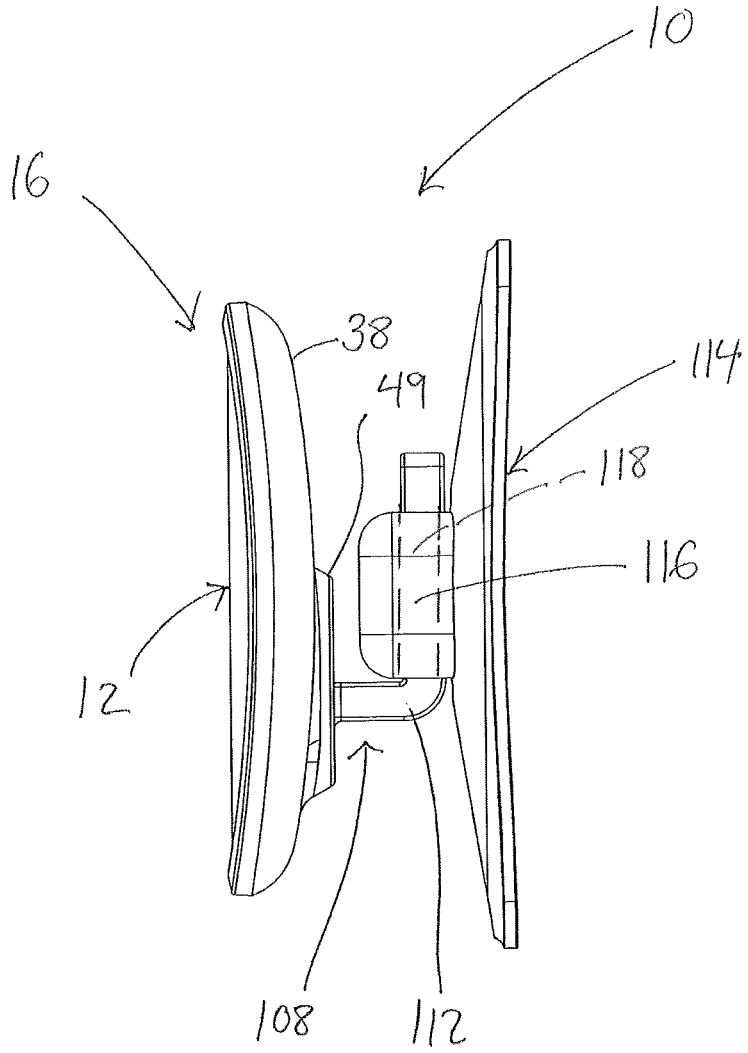
FIG. 39A is a side view of an assembled display holder comprising a suction support connector of FIGS. 37A and 37B.
Figure 39B:
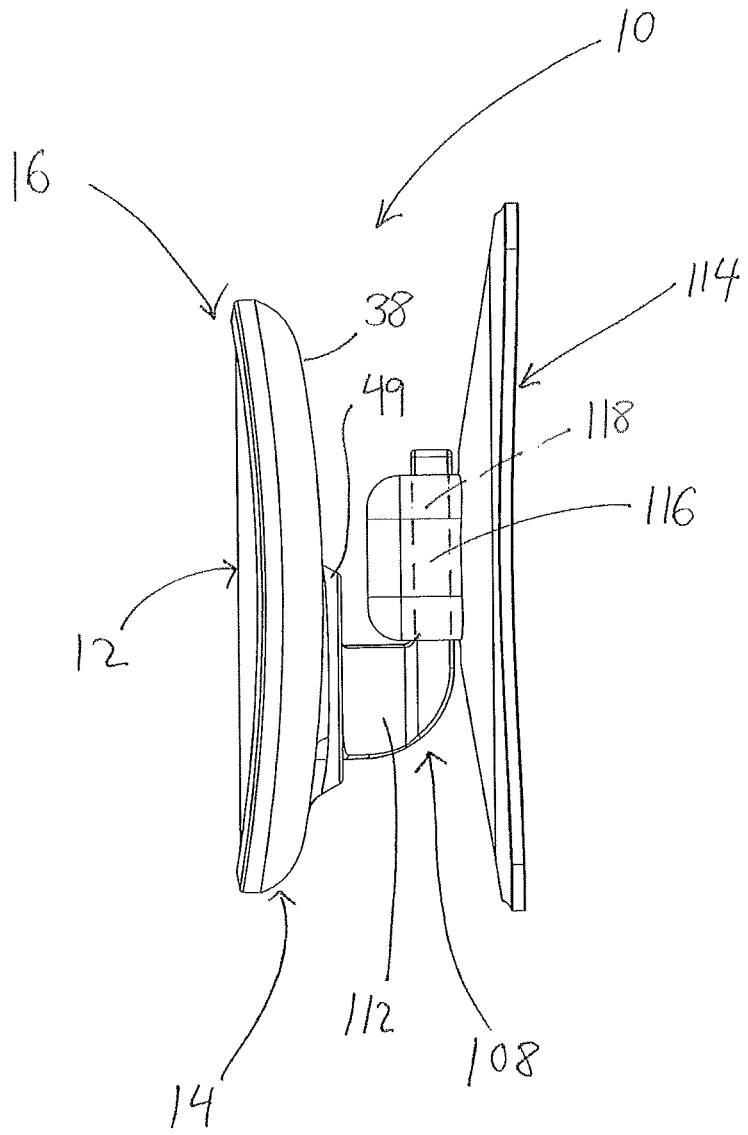
FIG. 39B is a side view of an assembled display holder comprising a suction support connector of FIGS. 38A and 38B.

FIGS. 37A and 37B illustrate one embodiment of suction cup support 108 for use as a second connector 54. FIGS. 38A and 38B illustrate an alternative embodiment having a reinforced body portion which is somewhat less flexible but better able to withstand pulling forces when suction accessory 114 is removed from a support surface. FIGS. 39A and 39B illustrate display holders 10 for supporting an oval-shaped display subassembly 16 using suction accessory 114. FIG. 39A illustrates the suction cup support 108 of FIGS. 37A, 37B and FIG. 39B illustrates the suction cup support 102 of FIGS. 38A, 38B.

Figure 40:
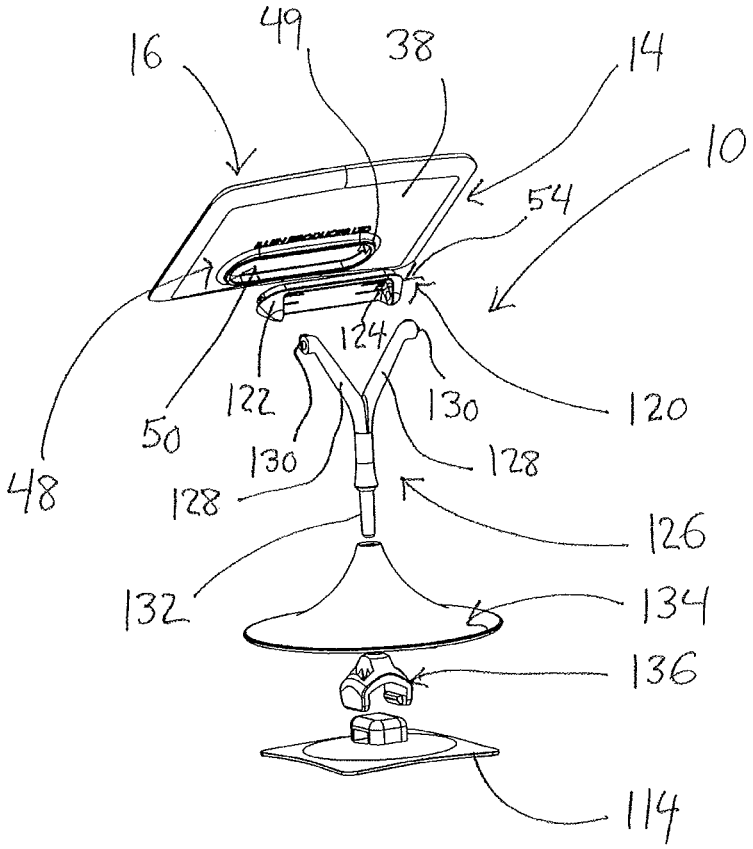
FIG. 40 is an exploded, rear perspective view of a display holder for pivotably supporting a display subassembly on an upright stand.
Figure 41:
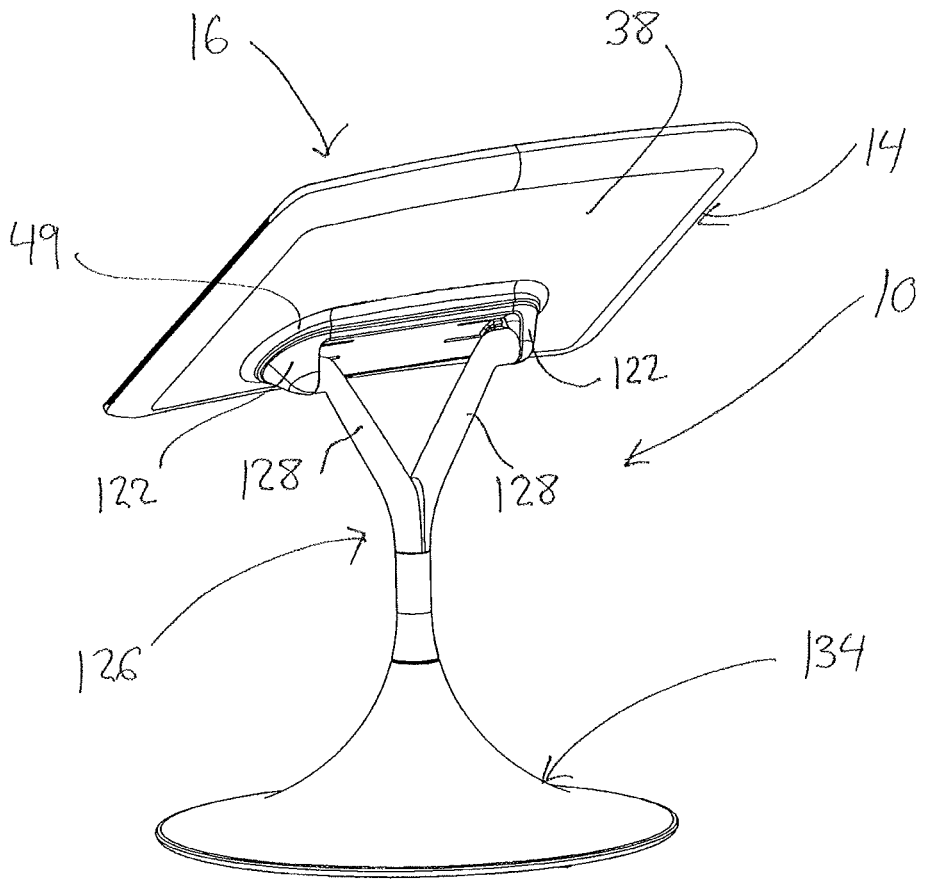
FIG. 41 is a rear perspective view of the display holder of FIG. 40 in an assembled configuration.
Figure 42A:
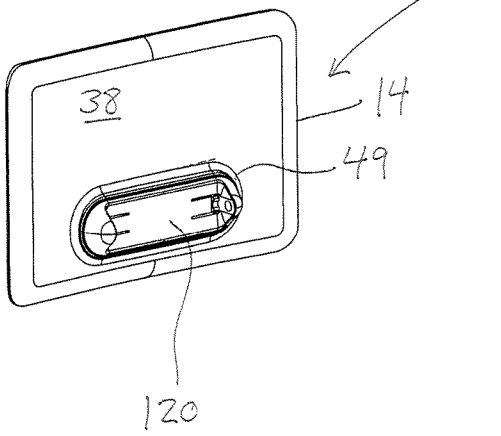
FIG. 42A is a rear perspective view of the display subassembly of FIG. 40 coupled to a pivot connector.
Figure 42B:
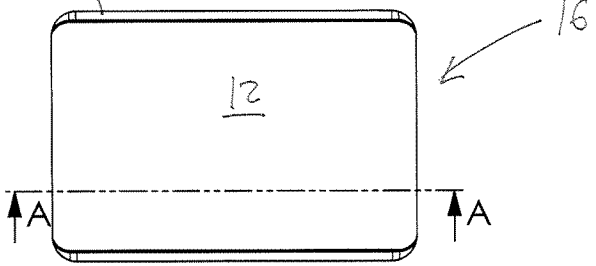
FIG. 42B is a front elevational view of the assembly of FIG. 42A.
Figure 42D:
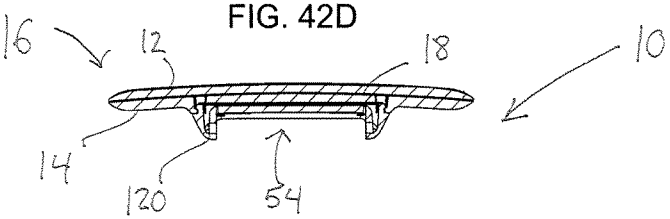
FIG. 42D is a longitudinal sectional view of the assembly of FIG. 42A taken along section lines A-A of FIG. 42B.
Figure 42C:
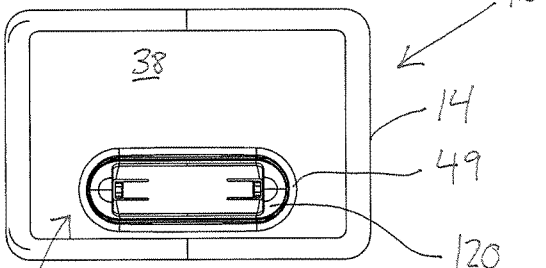
FIG. 42C is a rear elevational view of the assembly of FIG. 42A.
Figure 43:
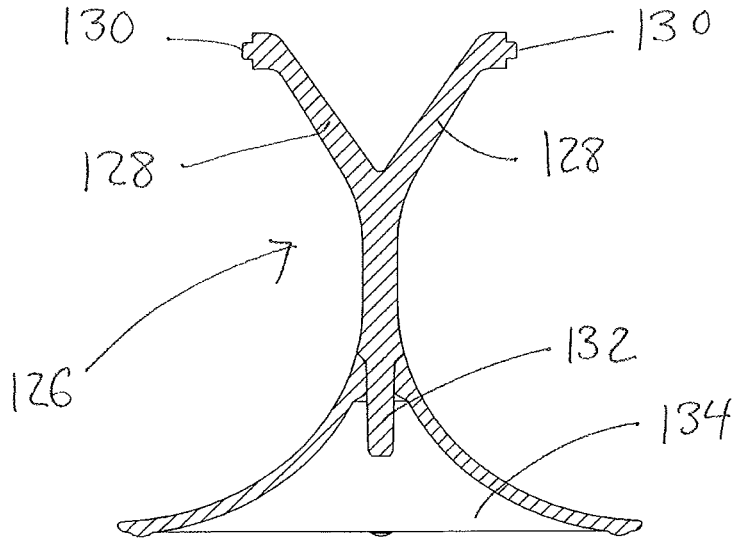
FIG. 43 is a cross-sectional view of the stem and base of the display holder of FIG. 40.
Figure 44:
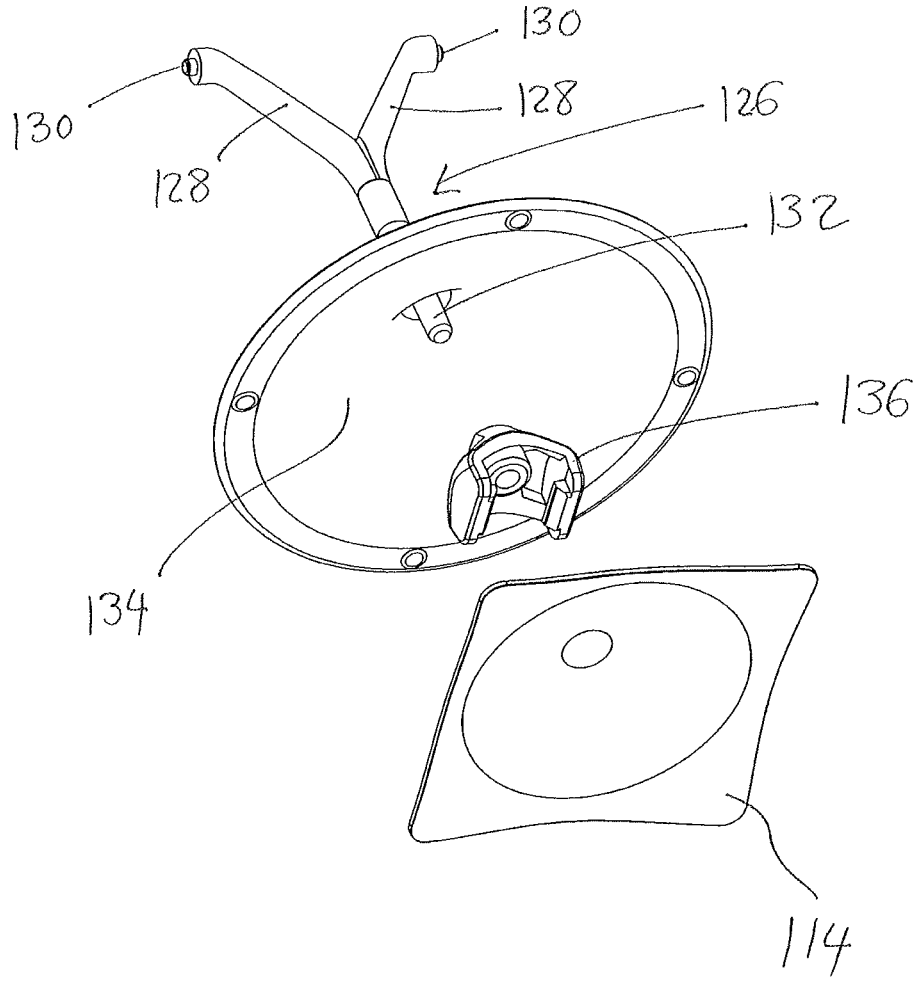
FIG. 44 is an exploded, bottom perspective view of the stem, base, clip and suction accessory of the display holder of FIG. 40.

FIGS. 40-44 illustrate another embodiment comprising suction accessory 114. In this embodiment second connector 54 comprises a pivot connector 120 connectable to first connector 48. Pivot connector 120 includes enlarged end portions 122 having tabs 58 for insertion into slots 52 of first connector 48 (FIGS. 40-42). End portions 122 have apertures 124 formed therein. A stem 126 having a pair of arms 128 may be pivotably connected to pivot connector 120. In particular, a pin 130 located at the end of each arm 128 is insertable into a corresponding aperture 124. A bottom shaft 132 of stem 126 is insertable through a base 134 to fasten to a clip 136 connectable to suction accessory 114 (FIG. 40). As shown in FIG. 41, when this embodiment of display holder 10 is assembled, suction accessory 114 and clip 136 are hidden from view. In embodiments where a suction mount is not necessary, suction accessory 114 and clip 136 could be omitted. In the embodiments of FIGS. 40-44, display subassembly 16 is pivotably adjustable relative to stem 126 to vary the angle thereof for optimum display purposes.

Figure 45:
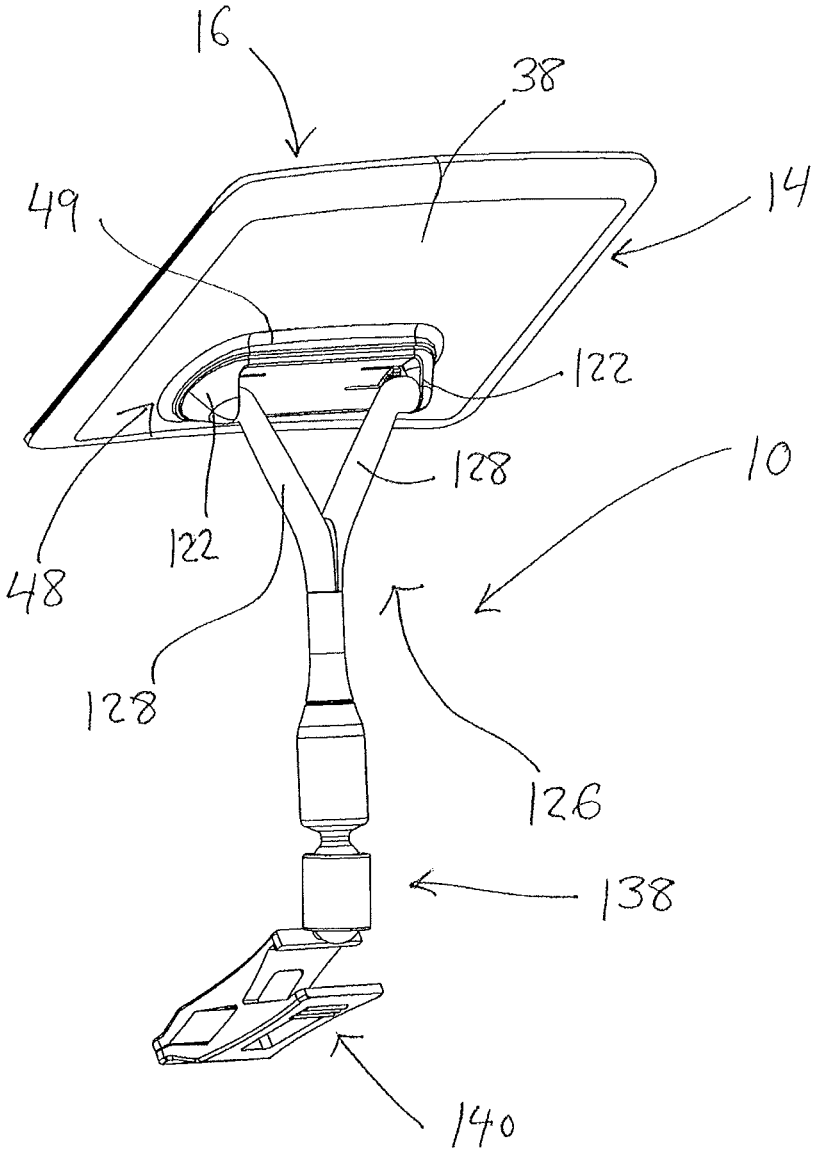
FIG. 45 is an embodiment of a display holder for clamping a display subassembly to a support surface.
Figure 46:
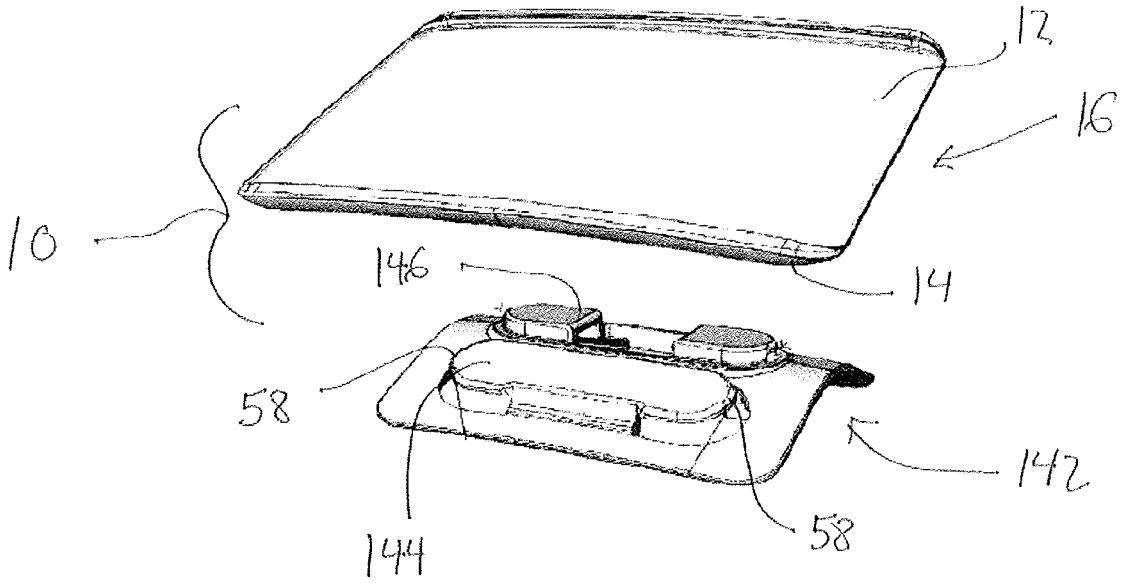
FIG. 46 is an exploded, front view of an embodiment of a display holder comprising a display subassembly connectable to a surface mount.
Figure 47:
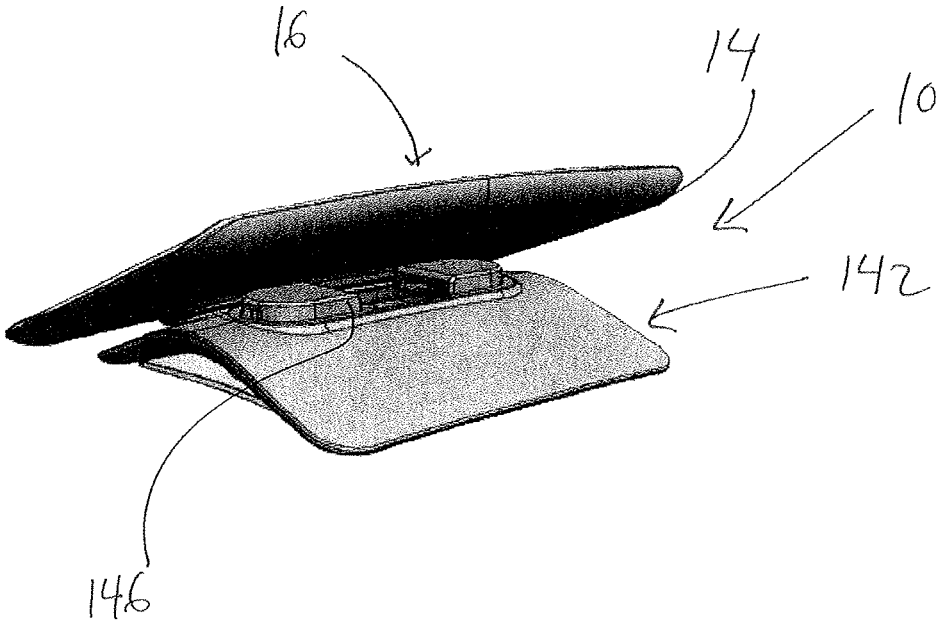
FIG. 47 is a rear perspective view of the display holder of FIG. 46 in an assembled configuration.

FIG. 45 illustrates an alternative embodiment where bottom shaft 132 of stem 134 is connectable to a clamp adaptor 138 which is connectable to a clamp 140. Clamp 140 may be secured to any desired support surface and display subassembly 16 may be pivoted as described above to the optimum display orientation.

Figure 48:
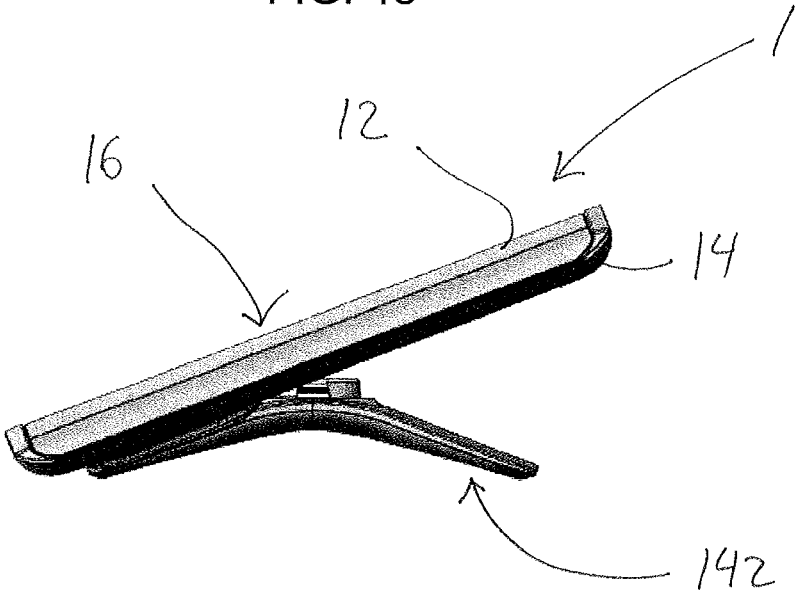
FIG. 48 is a side elevational view of the display holder of FIG. 47.
Figure 49:
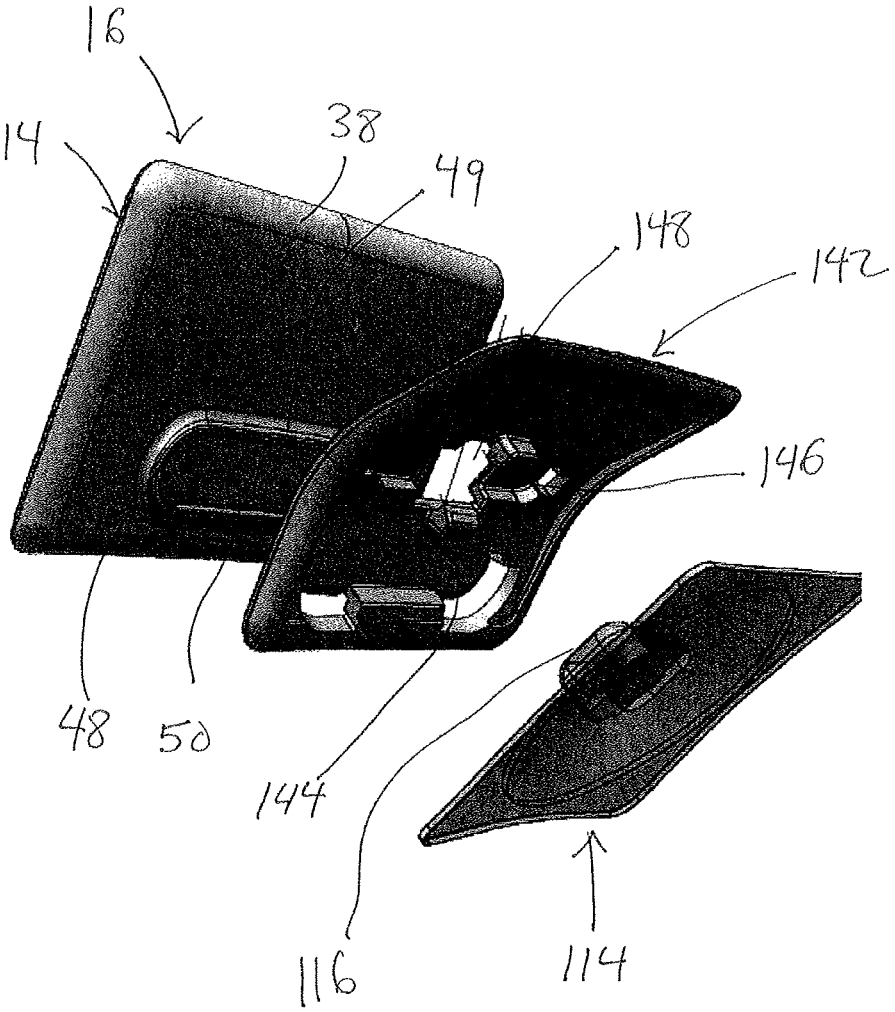
FIG. 49 is an exploded, rear perspective view of a display holder of FIG. 46 incorporating a suction accessory.

FIGS. 46-51 illustrates a further alternative embodiment which may be free-standing or comprise a suction accessory 114. In this embodiment second connector 54 comprises a surface mount 142 having a connector 144 comprising tabs 58 insertable into slots 52 of first connector 48. As shown in FIG. 48, display subassembly 16 may be coupled to connector 144 to form a low angle display holder 10. Alternatively, suction accessory 114 may be coupled to a connector 146 of surface mount 142 for mounting display holder 10 on a glass support structure or the like (FIGS. 49-51). Connector 146 includes an aperture 148 for receiving stem connector 116 of suction accessory 114.

As discussed above, display subassemblies 16 may be configured in a large number of shapes and sizes. By way of non-limiting examples, subassemblies 16 configured as name badges may be 1"×3" or ⅝"×3¼" in size; subassemblies configured as oval-shaped signs may be 1½"×3¼" or 2⅜×5½" in size; and subassemblies 16 configured as rectangular signs may be 2⅛"×3⅜", or 3"×5¼"; or 2"×8", or 2"×10" in size in particular embodiments.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A display holder comprising:

(a) display subassembly comprising (i) a cover; and (ii) a backer plate releasably connectable to said cover, said backer plate having a first connector formed on a rear surface of said backer plate, wherein said first connector comprises a recess defined by a rib projecting from said rear surface of said backer plate;

(iii) an insert sheet positionable between said cover and said backer plate, wherein said insert sheet is capable of bearing indicia for display and is visible through said cover; and (b) a plurality of different configured second connectors, wherein each of the plurality of different configured second connectors are releasably connectable to said first connector for positioning said display subassembly relative to a support surface.

2. The display holder of claim 1, wherein said backer plate is non-metal.

3. The display holder as defined in claim 1, when said cover and said backer plate are formed from molded plastic.

4. The display holder as defined in claim 1, wherein said cover and said backer plate are flexible.

5. The display holder as defined in claim 1, wherein said first connector and at least one of the plurality of said second connectors are releasably connectable by a snap-fit.

6. The display holder as defined in claim 1, wherein said first connector and at least one of said second connectors are adjustable between engaged and disengaged positions, and wherein said first connector and said at least one of said second connectors are adjustable from said engaged position to said disengaged position by flexing said backer plate.

7. The display holder as defined in claim 1, wherein at least one of said second connectors is releasably connectible to a support structure.

8. The display holder as defined in claim 1, wherein at least one of said second connectors is mounted on a support structure supporting said display holder on a support surface.

9. The display holder as defined in claim 8, wherein said support structure is free-standing.

10. The display holder as defined in claim 8, wherein said support structure comprises a base positionable on said support surface.

11. The display holder as defined in claim 8, wherein said support structure is configured for mounting said display subassembly on said support surface.

12. The display holder as defined in claim 8, wherein said support surface is an article of clothing.

13. The display holder as defined in claim 8, wherein said support structure comprises a stand positionable on said support surface.

14. The display holder as defined in claim 13, wherein said stand is deployable in a first orientation extending at an upright angle relative to said support surface and a second orientation extending at an inclined angle relative to said support surface.

15. The display holder as defined in claim 8, wherein said at least one of said second connectors comprises an integral portion of said support structure.

16. The display holder as defined in claim 8, wherein said display subassembly is pivotably coupled to said support structure.

17. The display holder as defined in claim 8, wherein said support structure comprises a suction accessory for securing said holder to said support surface by suction forces.

18. The display holder as defined in claim 8, wherein said support structure comprises a cramp for clamping said holder to said support surface.

19. The display holder as defined in claim 8, wherein said support structure comprises a stand for supporting multiple display subassemblies.

20. The display holder as defined in claim 8, wherein said support structure comprises a mounting plate comprising said second connector for supporting said subassembly on a support surface comprising a wall or door.

21. The display holder as defined in claim 1, wherein at least one of said second connectors is a magnet.

22. The display holder as defined in claim 1, wherein said backer plate comprises a plurality of first connectors formed on said rear surface.

23. The display holder as defined in claim 1, wherein said cover is transparent or translucent.

24. The display holder as defined in claim 1, wherein least one of said second connectors comprises an insert insertable into said recess.

25. The display holder as defined in claim 24, wherein said first connector comprises one or more slots formed in said backer plate within said recess.

26. The display holder as defined in claim 1, wherein said cover and said backer plate are inwardly concave.

27. The display holder as defined in claim 1, wherein said backer plate comprises a peripheral rim and wherein said cover fits within said rim.

28. The display holder as defined in claim 1, wherein said backer plate fits within said cover.

29. The display holder as defined in claim 1, wherein said display subassembly is configured as a sign selected from the group consisting of a name badge, an identification badge, a name plate, a desk plate, a door plate, a product sign, a wall sign, a table sign and a buffet sign.

30. A display holder comprising:

(a) display subassembly comprising (i) a cover; and (ii) a backer plate releasably connectable to said cover, said backer plate having a first connector located on a rear surface of said backer plate, wherein said first connector comprises a recess defined by a rib projecting from said rear surface of said backer plate;

(iii) an insert sheet positionable between said cover and said backer plate, wherein said insert sheet is capable of bearing indicia for display and is visible through said cover and (b) a plurality of different configured second connectors, wherein each of said plurality of different configured second connectors is releasably connectable to said first connector for positioning said display subassembly relative to a support surface, wherein said first connector and each of said plurality of second connectors are adjustable between engaged and disengaged positions, and wherein said first connector and each of said plurality of second connectors are adjustable from said engaged position to said disengaged position by flexing said backer plate.

* * * * *